US008779920B2

(12) United States Patent
Garnier et al.

(10) Patent No.: US 8,779,920 B2
(45) Date of Patent: Jul. 15, 2014

(54) MULTITHREAT SAFETY AND SECURITY SYSTEM AND SPECIFICATION METHOD THEREOF

(75) Inventors: Bernard Garnier, Valbonne (FR); Antoine Guillot, Paris (FR); Johannes Hiemstra, Hengelo (NL); Ger Koelman, Hengelo (NL)

(73) Assignee: Thales Nederland B.V., Hengelo (NL)

( * ) Notice: Subject to any disclaimer, the term of this patent is extended or adjusted under 35 U.S.C. 154(b) by 1024 days.

(21) Appl. No.: 12/356,657

(22) Filed: Jan. 21, 2009

(65) Prior Publication Data

US 2009/0207020 A1 Aug. 20, 2009

(30) Foreign Application Priority Data

Jan. 21, 2008 (NL) ..... 1034935

(51) Int. Cl.
*G08B 13/00* (2006.01)
*G08B 21/12* (2006.01)

(52) U.S. Cl.
CPC ..... *G08B 21/12* (2013.01)
USPC ..... 340/541; 340/436

(58) Field of Classification Search
USPC ..... 340/541, 436; 707/758, 4, 83, 483; 701/301
See application file for complete search history.

(56) References Cited

U.S. PATENT DOCUMENTS

| | | | | |
|---|---|---|---|---|
| 5,971,580 | A | 10/1999 | Hall et al. | |
| 6,249,241 | B1 | 6/2001 | Jordan et al. | |
| 6,405,213 | B1 * | 6/2002 | Layson et al. | 707/758 |
| 2005/0002561 | A1 | 1/2005 | Monachino et al. | |
| 2006/0041381 | A1 * | 2/2006 | Simon et al. | 701/301 |
| 2006/0238406 | A1 | 10/2006 | Nohara et al. | |
| 2007/0208725 | A1 * | 9/2007 | Gilger et al. | 707/4 |

FOREIGN PATENT DOCUMENTS

| | | | |
|---|---|---|---|
| DE | 694 28 631 | T2 | 10/2001 |
| EP | 0 769 705 | B1 | 4/1997 |
| EP | 1 087 200 | B1 | 3/2001 |
| EP | 1 814 054 | A1 | 8/2007 |
| EP | 2 074 602 | B1 | 7/2009 |
| EP | 2 081 163 | B1 | 7/2009 |
| WO | WO 02/067142 | | 8/2002 |
| WO | 2005124714 | A | 12/2005 |
| WO | WO 2005/124714 | A1 | 12/2005 |
| WO | WO 2006/137072 | A2 | 12/2006 |

OTHER PUBLICATIONS

English translation of Opposition filed against European patent No. 2 081 163 B1 dated Jul. 19, 2012.
European Search Report from European Patent Application No. 08161440 issued May 28, 2009.

* cited by examiner

*Primary Examiner* — Shirley Lu
(74) *Attorney, Agent, or Firm* — Stroock & Stroock & Lavan LLP

(57) ABSTRACT

The invention relates to a safety and security system designed to protect a designated area. The system comprises sensors of various types (radars, infrared detectors for instance) and sources of intelligence. Correlation is run between instant-track data and non-instant-track data before the level of threat of the tracks is analyzed. Reliability of this analysis is thus greatly enhanced. Also a method is provided to develop systems of this type which provides an integrated specification and design method which covers technical and human factors.

22 Claims, 17 Drawing Sheets

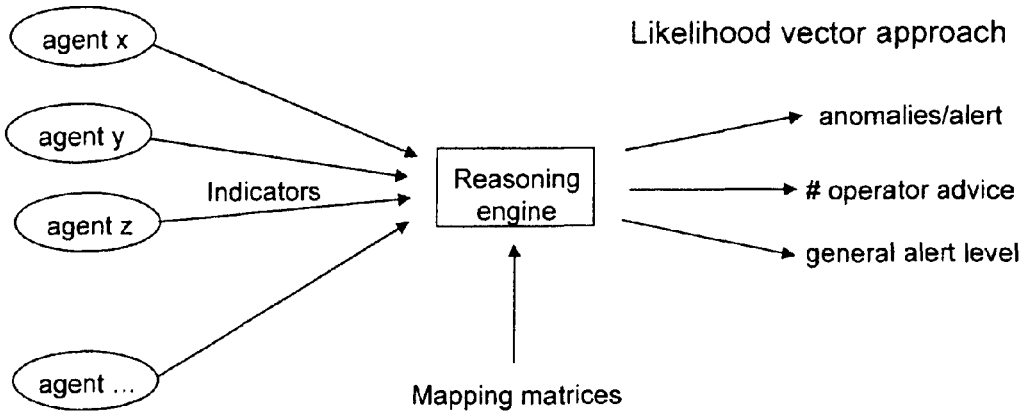
FIG.4C
| | | estimation | |
|---|---|---|---|
| indicator | observation | High anomaly P(e\|A) | Low anomaly P(e\|¬A) |
| track appearance | P(e\| normal) | P(normal \| A) | P(normal \| ¬A) |
| | P(e\|¬normal ) | P(¬normal \| A) | P(¬normal \| ¬A) |
Mapping matrices
FIG. 4D
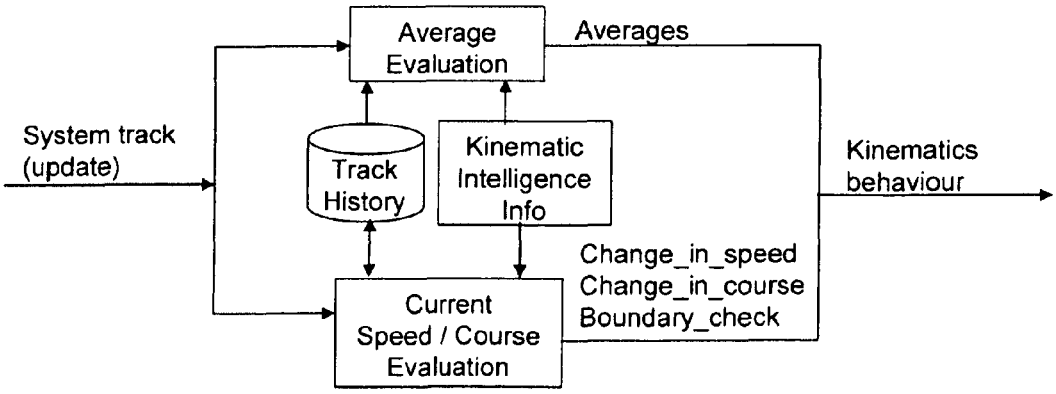
FIG.6

MULTITHREAT SAFETY AND SECURITY SYSTEM AND SPECIFICATION METHOD THEREOF

CROSS REFERENCE TO RELATED APPLICATION

The present application claims priority to Netherlands Application No. 1034935 filed Jan. 21, 2008. The entirety of the application is incorporated herein by reference.

FIELD OF THE INVENTION

This invention belongs to the safety and security systems domain. More specifically, when the purpose of the system is to ensure global safety and security of a large area, design and operational concepts as well as equipments and information processing will be of a kind similar to those used in military Command, Control, Communications, Computers, Intelligence, Surveillance and Recognition (C4ISR) systems.

BACKGROUND OF THE INVENTION

Unlike this last category of systems, safety and security systems of the type of this invention do not have the purpose of managing military operations. They have the goal of dealing with violations of specific laws and regulations and with certain type of threats like terrorism, drug smuggling, counterfeiting or environmental hazard. In most countries, dealing with these threats is the responsibility of one or more administrative agencies or ministerial departments, sometimes coordinated by a homeland security department. The system is based on a variety of sensors of different technologies (electromagnetic, electro-optical, electro-acoustic) such as radars, sonars, laser imaging systems and communication equipment such as VHF transmission. These devices are either permanently positioned in adequate locations or on-board a carrier. The carrier may be a terrestrial, above or under water vehicle or an aircraft, all manned or unmanned, a buoy or a satellite. It is also possible that one or more specific sub-systems also report intelligence data collected from sources such as communications monitoring, on-field human observation, Internet traffic supervision or like means.

A privileged domain to use such systems is safety and security since all risks mentioned above are possibly present and a significant number of agencies may be involved. But prior art systems have significant limitations.

A first limitation of prior art systems which have the purpose of addressing multiple threats, is that sensor monitoring systems generally process instant tracks. Data from multiple sensors may be fused and identification data may be obtained from Automatic Identification Systems (AIS) which have been made compulsory by the International Maritime Organisation (IMO) on-board commercial ships above a certain size. But then the operators of the operations centers are left without more assistance to help them correlate instant-track and non-instant-track data, for instance data coming from different sensors and from intelligence sources or effectuate consistency checks, analyse deviations from expected patterns in order to detect anomalies with a sufficient level of confidence. Lack of integration of streams of data from different origins has the consequence of complex man machine interfaces and of lower efficiency of the operators who have decisions to make.

A second limitation of prior art systems becomes apparent at the time of designing a system of this kind. These systems are of a "man-in the loop" (MITL) type in the sense that they require human intervention before an action is taken. As a consequence, the Human Computer Interface (HCI) is even more critical than to other systems to the operational efficiency of the system and its manning requirements. The standard specification process is to address the technical specification items independently from the operational requirements. The lack of integration of the two categories of goals, inputs and constraints will result in significant redesign at various stages to the project and in a sub-optimal system at the end, in terms of reliability of the alerts and overall operational cost.

BRIEF SUMMARY OF THE INVENTION

It is a purpose of the present invention to overcome both limitations. The invention provides a multi-threat safety and security system which is capable of integrating instant track data and non instant track data to increase the efficiency of the operators in assigning threat levels to tracks. Adequacy of the design of the system to the operational requirements of the users is enhanced through integration of organisational and technical goals and constraints in a same specification and design process.

To these effects, the inventions provides a safety and security system for a definite area comprising sensors fit for capturing a first set of instant-track data on a first set of objects located in said area or in the vicinity thereof, information sources fit for capturing a second set of non instant-track data on a second set of objects wherein it further includes a set of computer processes fit for correlating members of the first set of objects with members of the second set of objects and for computing threat levels of the members of the first set of objects from said first and second sets of data assigned to said members.

It also provides a method for designing the specification of a safety and security system for an area comprising the steps of defining through at least one interaction with some of the users of the system the missions to be performed by the system and the resources fit to accomplish said missions wherein said resources are of a type selected from a group comprising at least sensors, information sources, operations centers, communications network and manning requirements.

The invention also has the advantage of bringing multiple decision support tools to the operators, these tools being integrated in a single human computer interface which has been designed from start based on the operational requirements. It also has the advantage of giving better control to the users on budget planning since the definition of manning requirements is built in the specification phase. The system is also very flexible and versatile since most organisation parameters can be configured by the users and in some instances made dynamic.

BRIEF DESCRIPTION OF THE DRAWINGS

The invention will be better understood and its various features and advantages will be made more apparent from the description herebelow of some of the possible embodiments and from the appended drawings, among which:

FIGS. 4A, 4B, 4C and 4D are logical diagrams of the operation of an anomaly detection and handling function in a number of embodiments of the invention;

FIG. 6 is a logical diagram of an analysis function of the expected kinematics according to an embodiment of the invention;

DETAILED DESCRIPTION

In the specification, claims and drawings, the abbreviations and acronyms have the meaning indicated in the table below, except if otherwise mentioned in the text

| Abbreviation | Meaning |
|---|---|
| AIS | Automatic Identification System |
| BU | Buoy |
| BUC | Business Use Case |
| C4ISR | Command, Control, Communications, Computers, Intelligence, Surveillance and Recognition |
| CONOPS | Concept of Operations |
| COP | Common Operational Picture |
| COTS | Commercial Off The Shelf |
| CPA | Closest Point of Approach |
| CSSS | Coastal Safety and Security System |
| CW | Coastal Waters |
| EA | Electro-Acoustic |
| EEZ | Exclusive Economic Zone |
| EO | Electro-Optical |
| ETA | Estimated Time of Arrival |
| GIS | Geographic Information System |
| GNSS | Global Navigation Satellite System |
| GPS | Global Positioning System |
| GUI | Graphical User Interface |
| HCI | Human Computer Interaction |
| IMO | International Maritime Organisation |
| LRIT | Long Range Identification and Tracking |
| MITL | Man In The Loop |
| MMSI | Maritime Mobile Service Identity |
| NOC | National Operations Center |
| NUC | Not Under Command |
| POA | Port Of Arrival |
| POD | Port Of Departure |
| RD | Radar sensor |
| ROC | Regional Operation Center |
| ROP | Regional Operational Picture |
| RDF | Radio Direction Finder |
| RF | Radio frequency |
| RSD | Rational Software Developer |
| SAR | Synthetic Aperture Radar |

-continued

| Abbreviation | Meaning |
|---|---|
| SAT | Satellite |
| SUC | System Use Case |
| TTW | Territorial Waters |
| UML | Unified Modelling Language |
| VoIP | Voice on IP |
| VTMIS | Vessel Traffic Management Information System |
| VTS | Vessel Traffic Services |

The invention may apply to different types of areas, terrestrial or naval, but its preferred embodiment is a coastal safety and security system (CSSS) or a combined land and sea safety and security system. In specific parts of the world like the Mediterranean, Black, Red and Caribbean seas, as well as the Gibraltar, Malacca and like straits, the illegal activities such as drug and counterfeit smuggling, illegal immigration, terrorist activities are quite substantial and take the opportunity of a very significant commercial traffic to move undercover. This kind of context is very demanding in terms of system performance to be able to extract low signals from a lot of noise and correlate multiple sources of information. This is why this invention is specifically targeted to these applications. But nothing prevents it to be applied in other contexts, even if most of the specification is dedicated to these.

Figure 1:
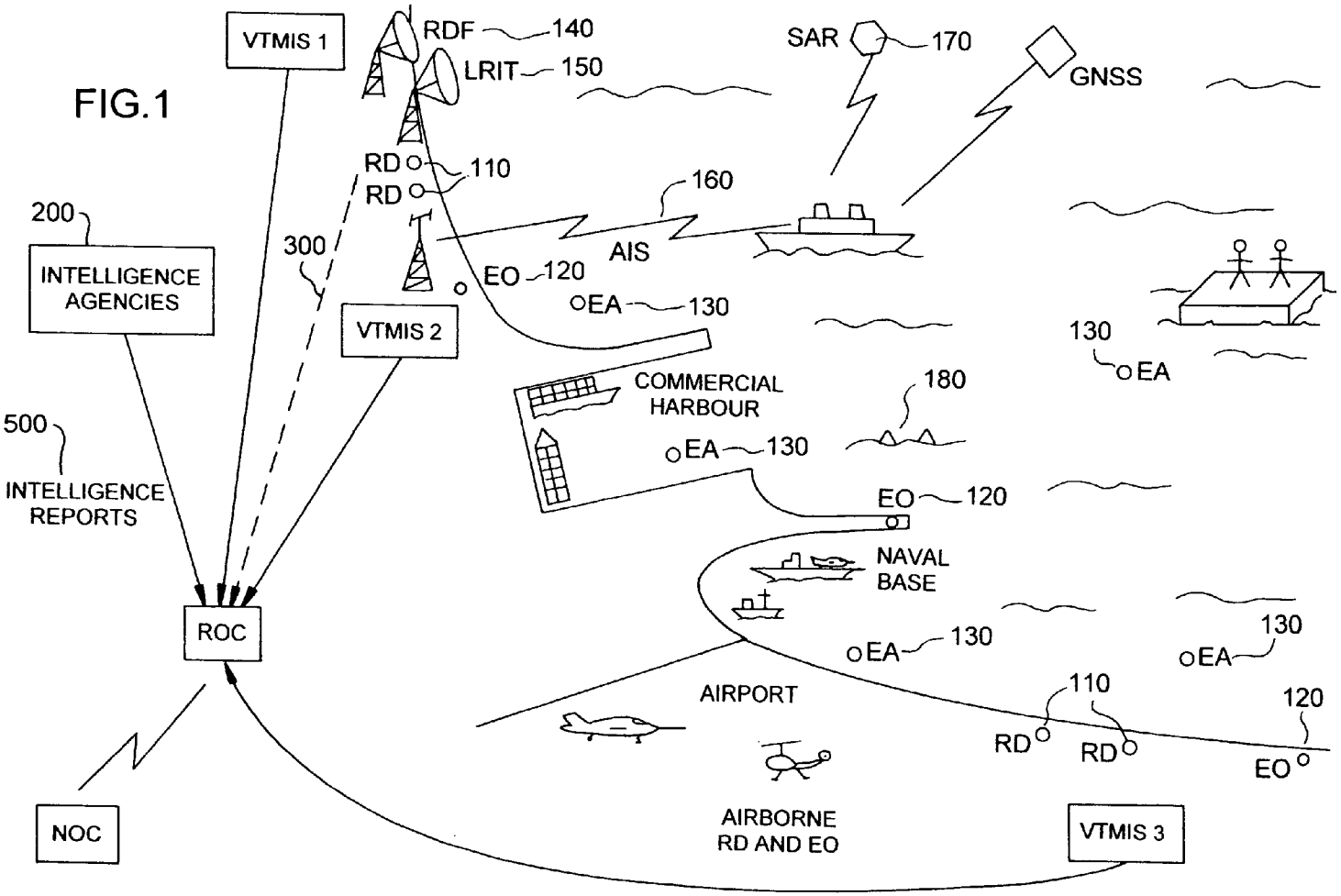
FIG. 1 illustrates the lay out of a safety and security system

FIG. 1 is an illustrative layout of a coastal safety and security system (CSSS). The purpose of a CSSS is to give the authority in charge sufficient and timely information to counter illegal activities and address a variety of threats, possibly targeted at sensitive sites. Illegal activities such as drug, counterfeit or immigrants trafficking often use coasts to smuggle their payloads into a country because they can find there numerous hiding and storage places. Specific asymmetric threats can target harbours, naval bases, off-shore platforms. In post 9/11 semantics, threats are qualified asymmetric when a small number of poorly equipped people, can cause significant damage to a high number of richly equipped people. Typical scenarios will include a small fishing boat exploding an off-shore oil rig or an anchored frigate. Protection against asymmetric threats is highly difficult because nothing specific will distinguish a small fishing boat manned by terrorists loaded with explosives from the dozen neighbouring ones manned by fishermen and loaded with fish.

A number of equipments and systems have been developed to assure protection against environmental risks and maritime border violation and to counter asymmetric threats.

To monitor commercial vessels, the International Maritime Organisation has developed a set of standards with compulsory identification rules and equipment geared at controlling this identification. These tools are known as Automatic Identification Systems (AIS), 160: the ship 200 is equipped with an RF transponder which will regularly broadcast in an allocated bandwidth signals carrying formatted data. Range of an AIS is 30-40 km. A first part of the data is constant and entered manually, such as: the Maritime Mobile Service Identity (MMSI)—a 9 digits unique identifier of on-board RF equipments, IMO number, call sign and name, length and beam, location of position fixing antenna on the ship. A second part of the data is variable input and is collected automatically by the AIS, mostly from Global Navigation Satellite System (GNSS) data: ship's position with accuracy indication and integrity status, position time stamp, course and speed over ground, heading, rate of turn, navigational status (such as Not Under Command or NUC, at anchor, etc.), with optional additional data on angle of heel, pitch, roll and additional on-board sensors data. A third part relates to voyage data and is at master's discretion or as required by competent authority: ship's draught, hazardous cargo (type and other data, as required by competent authority), destination, Estimated Time of Arrival (ETA), waypoints and, optionally, route plan (last field not provided in basic message).

An other type of cooperative information system is Long Range Identification and Tracking (LRIT), 150. This is developed under the auspices of the IMO to provide through a network of service providers positioning and identification data to the members of the network world wide. This will be mandatory for certain categories of ships as of Jan. 1, 2008.

Different sensors are also provided to acquire non-cooperative track data of above or underwater vessels and aeroplanes. These comprise electro-magnetic sensors, mostly radars, standard fixed radars (RD), 110, airborne radars, electro-optical sensors (EO), 120, such as lasers or infra-red devices, fixed, air or vessel carried, radio direction finding devices (RDF), 140, electro-acoustic sensors (EA), 130, such as sonars which may also be fixed or vessel or helicopter carried. Surveillance satellites (SAT) equipped with Synthetic Aperture Radars (SAR), 170, can also provide track information. Also, buoys (BU), 180, carrying various short range sensors (small RD, EA) can be deployed as part of the surveillance of sensitive sites or to replace or supplement longer range coastal sensors. Coverage ensured by the various sensors will be a function of their performance, the characteristics of the terrain to be covered (natural obstacles, such as relief and forests, human made obstacles such as buildings or RF interferences) and available communications links. These factors will determine sensors optimum location.

Sensors data should then be processed before being presented to operators tasked to interpret them. This can be done in an interface equipment directly connected to the system and there may be different locations of the front-end conditioning/signal processing/data processing of the sensors outputs depending upon the signals throughput and the distance between the sensors and the operations centers (Regional Operations Centres or ROC). A part of the specification of the system will be to select the sensors data fusion and classification tools as a function of the type of targets to be detected, identified and tracked. Performance of these tools is an important part of the performance of the system as a whole but is not an object of the present invention.

ROCs are staffed with people tasked with correlating track data from the sensors in their area of responsibility, integrate this data with information received from sub-systems and intelligence sources and decide on actions to be taken, based on this information.

A first class of sub-systems specifically relevant for a CSSS includes Vessel Traffic Services (VTS). VTS track vessels moving in a port area and presents and records identification, bearing, speed, ETA, ETD and other data relating to these tracks. A second class of sub-systems which can feed track data into a ROC includes Vessel Traffic Management Information System (VTMIS). VTMIS cover larger maritime areas and provide more sophisticated information such as fusing the tracks from a plurality of sensors (of the same categories—i.e., radars positioned in different locations—or of different categories—RD and EA, RD and RDF for instance), when they capture the same target, integrating radar and AIS data, for example.

Intelligence sources will provide information on possible events such as vessel suspect of past violation of environmental regulations, expected delivery dates, locations and actors of a smuggling operation, possible terrorist action. Depending upon the size and configuration of the area to be monitored, multiple ROCs may be themselves controlled by a National Operations Center (NOC). It will be up to the operators of the ROCs and NOC to correlate the information they receive from the different information sources to take the adequate course of action. It is the object of the present invention to provide the operators of the ROCs and possibly NOC, with tools to automate this information sources correlation process. As illustrated by the top right hand side of the logical diagram of FIG. 2, an area security system according to this invention will process sensors data (from RD, RDF, EO, EA, AIS, SAT, BU sensors), 110, which qualify as "instant-track" data 300 in the sense that they deliver to the system 3D coordinates and speed of the target in real and present time. Some sensors will also deliver a classification result. And AIS 160 will give a supposed identity of the vessel. This data is temporarily stored in a database DB1 and used to present the targets tracks on the operators console at VTS, VTM IS, ROC and NOC levels. Through specific processes 700, this instant-track data is conditioned and stored in an other database DB2. It is to be noted that DB1 can be physically the same database even if the instant-track and non-instant-track data are logically distinct. The conditioning processes have the purpose of preparing the data for use in the correlation and threat level assessment processes and will be described further with these processes.

Figure 2:
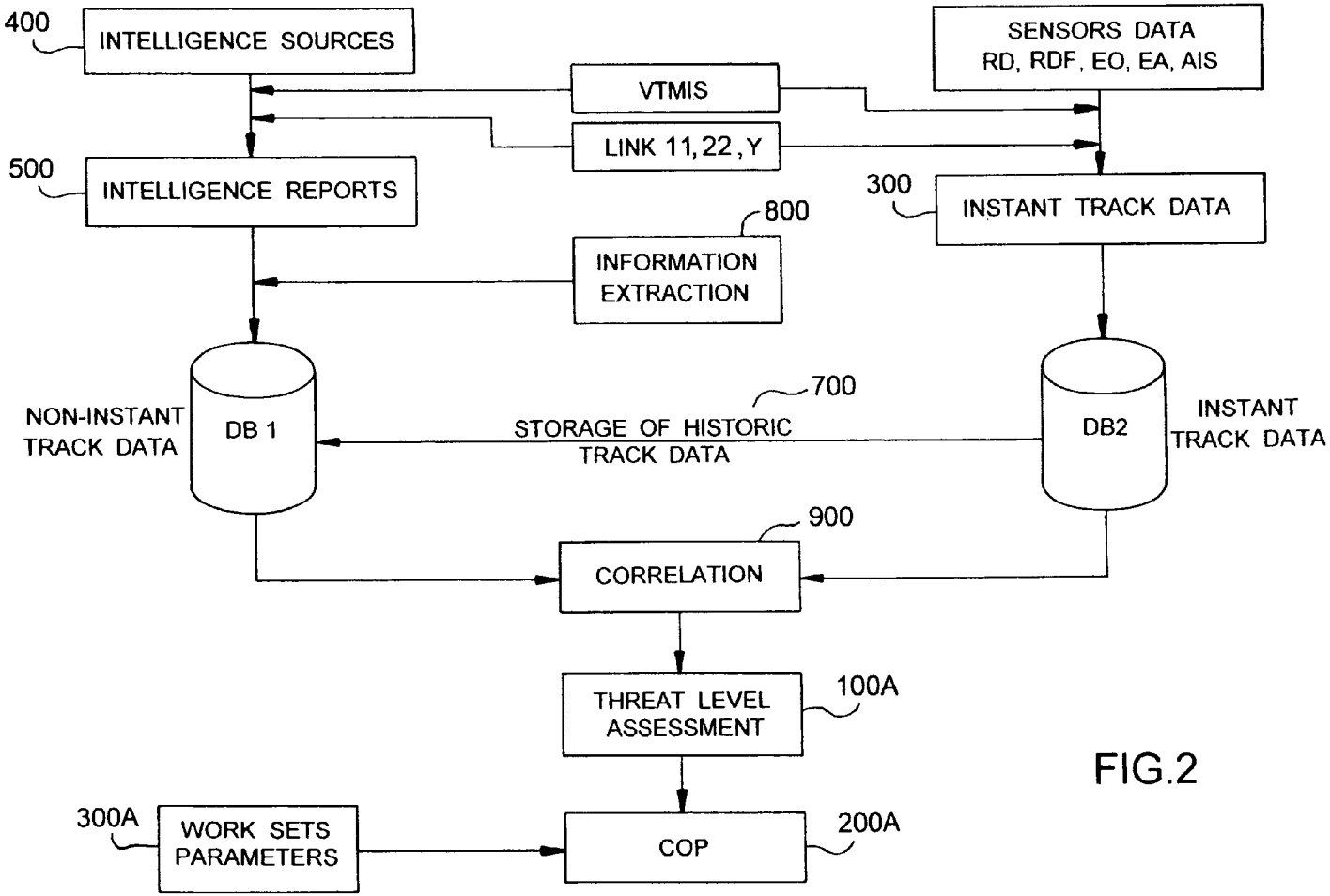
FIG. 2 is a logical diagram of the operation of a safety and security system in an embodiment of the invention.

On the left hand side of the diagram of FIG. 2, is represented the logical processing of data acquired from intelligence sources 400. Said data will generally come from intelligence agencies under common authority with the authority controlling the ROCs and NOC, for instance the Navy or the Coastguards. But it may also come from agencies under the authority of an other army or from the Joint Chief of Staff office or from civilian agencies or even from international sources. The data will be presented in written intelligence reports 500. Some reports may be structured, for example when dealing with well defined events such as the delivery of a cargo which may be of a number of types (e.g., arms, ammunition, drug) by a vessel which may be exactly identified (e.g., name, flag, owner, crew) or identified by only a subset of these characteristics. These fields can be directly automatically input in the database DB2. Most often, the reports will be unstructured, i.e., with no identified data fields which can be automatically input to a database without specific intermediate processing. Information extraction processes and tools have been developed to this effect. Such tools are described in patent application EP1364316 assigned to Thales. Said tools are capable, after a learning process, to automatically select the contexts of instances of classes/entities of information to be extracted and also to identify relations existing in the text between the relevant entities. The information can then be stored in a database structured by class of information and/or relations. These tools will use semantic and morphosyntaxic analysis algorithms with finite state machines or transducers. Of course, part of the intelligence reports will be manually input into DB2 and consistency of automatic data input will be checked either systematically for some sensitive data fields or statistically so that the learning process can be improved. The information extraction process 800 includes both manual and automatic sub processes.

We can see on FIG. 2 that some sub-systems may provide two kinds of data: instant-track and non-instant-track. This is the case for VTMIS because such systems normally record all tracks for audit purposes and this information can be used to feed historic track data directly to DB1. This is also the case of a Link 11, Link 16, Link 22, Link Y or other data link sub-system. These fleet communication systems transmit both instant and non-instant track data acquired by the members of the fleet to their command center. This data will be stored either in DB1 or in DB2 according to preset rules. This variation in architecture and location of some of the functions does not alter the difference in nature between instant-track and non-instant-data and the processes which then interrelate both.

Correlation processes 900 will be run between DB1 and DB2. Various types of correlation processes may be used. A first type of correlation is very simple, when the same identification data is present in the two databases. This is the case for AIS, LRIT, VTS, VTMIS data present in DB1 and DB2 which can be qualified as "declaratory". It may be the case for instant track data and near-instant data, that is to say for a tracked vessel for which data will be the same in the two databases for each instant within a preset timeframe. In this case, data will be extracted from DB2 to run the consistency check described herebelow. It may also be the case for other sensors data where targets have a non ambiguous signature and can be identified with certainty, for example by the VTMIS which includes itself a signature and identification process. A second type of process is a classification process where instant-track data passed to DB1 contains the type of sensor-tracked target. The target class will be matched to classes present in DB2 to run anomaly detection and handling processes which are based on deviation from standard behaviour of a class, such as the kinematics, tactical risk, history footprint of tracks, deviation from track, trade pattern evaluation, deviation from standard track processes described herebelow. Of course, there can be different types of processes run at the ROC level itself depending on what kind of correlation and fusion processes are run at sub-systems level. For instance, a VTMIS normally provides a single track per target and can identify the track by correlating said track, possibly aided by an other type of dedicated sensor (EO, EA, IR), with a signature database. But the same processes can be run directly at the ROC level for data acquired from sensors directly connected to said ROC and not through a VTMIS. A third type of process is dedicated to the correlation of intelligence sources data and instant-track data. It is possible that the intelligence sources data contains unambiguous identification data, but it is seldom the case. In most cases, a specific correlation process will have to be run. When the intelligence sources deliver track related information, data fields such as type of carrier, expected destination, expected route, time window of expected arrival at a waypoint will be present in DB2. Sensors data will deliver corresponding data fields. The correlation process matches corresponding data fields with user defined confidence brackets and number of matching results and establishes relational links between the matching intelligence reports and tracks. When the intelligence sources deliver non-track related data, the correlation process is similar to a process of the second type described hereabove but can be run two ways: a class of intelligence data is selected and classes of tracks are connected to it; or a class of tracks is selected and classes of intelligence reports are connected to it. Examples are given further in the description of the intelligence handling and distribution processes.

The level of confidence for the result of the correlation process to be passed to the threat level analysis process is defined by the user. A tuning process is run from time to time to ensure that the level of confidence can be guaranteed.

The threat level analysis process 100A is run on the subset of the DB1 records which have been correlated with DB2 records. It is part of the design of the system to make sure that all potential threats are captured in scenarios for which the non-instant track database DB2 includes classification data versus which the instant-track data on DB1 records can be compared. This is an advantage of the specification method which is provided as part of this invention to provide tools to make sure this coverage of the risks is sufficient, not only in terms of sensors but more over in terms of analysis of the categories of risks and targets to be controlled.

Figure 3:
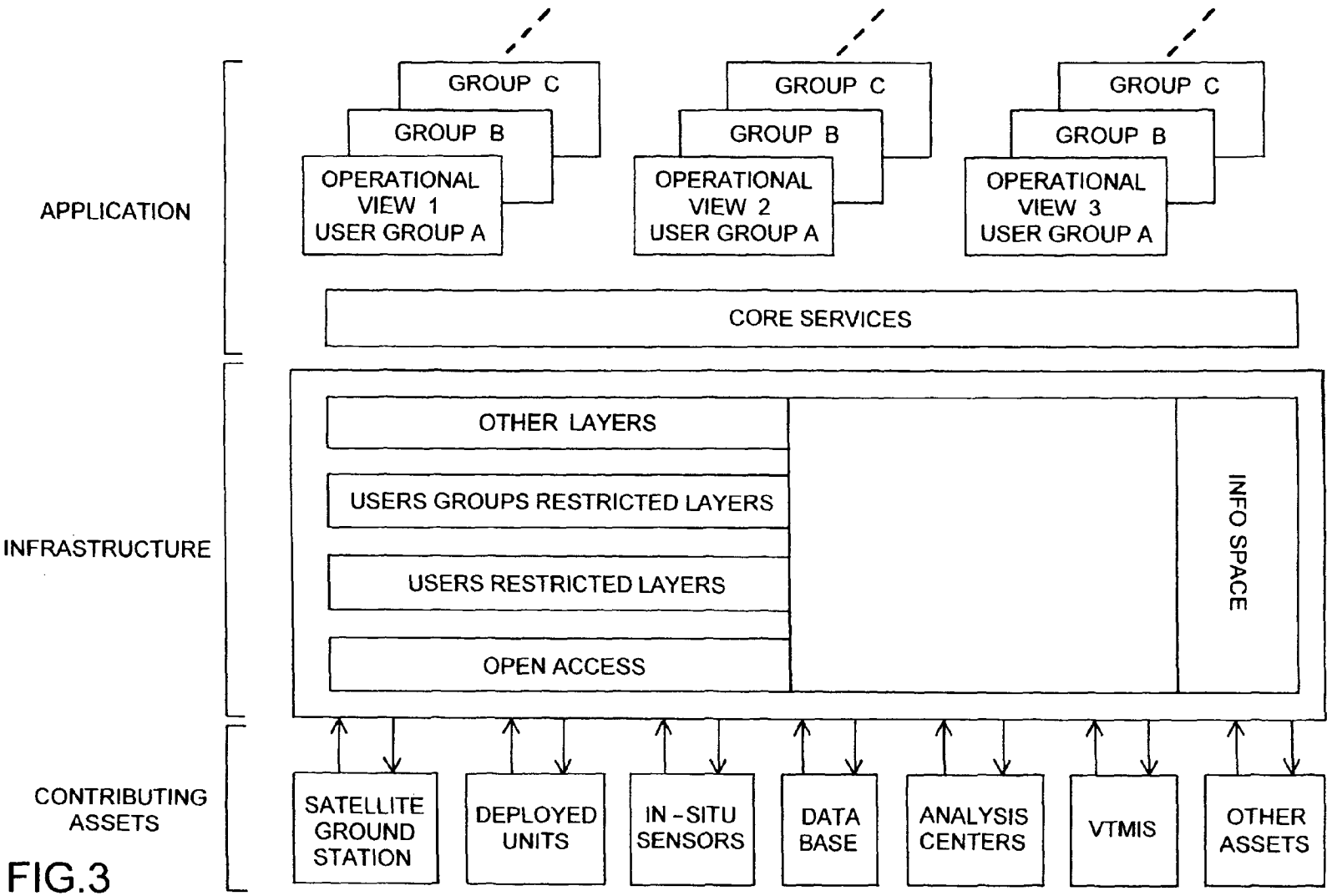
FIG. 3 illustrates the information processing architecture in an embodiment of the invention.

FIG. 3 displays an architecture of the information processing in an embodiment of the invention. The architecture includes three layers.

Level 1 is made up by "contributing assets", i.e., the sources of instant-track and non-instant-track data to be used to assess the level of threats of various targets. The list on these sources of instant and non-instant track data is given for illustrating purposes only: it includes in-situ sensors, 1i0, VTS, VTMIS, deployed units through a Link 11, 22 or Y communication, satellite ground stations, analysis centers, databases, etc.

Level 2 is made up by the infrastructure or Infospace of the CSSS. This layer provides information distribution backbones, data models, a data conversion toolbox, an information extraction tool, security functions (confidentiality, availability, integrity), physical segregation, firewalls, access management, user's certification and identification (described in more detail in the part of the description dedicated to intelligence distribution and handling), authorised sources of information, data correlation and aggregation toolbox (described hereinabove) and systems facilities such as resources planning, management and logistical support. A part of this layer 2 is open access. Other parts will be restricted either to a list of users or to classes of users. As explained with the rules for distributing intelligence, these restriction may change dynamically, depending upon the situation in which the CSSS is operated (e.g., normal, alert, intervention).

Level 3 is the application layer. This layer itself can be split between core services available to all classes of users across the different organisations among which the CSSS is deployed and user specific services with different types of applications for different classes of users. It may for instance very well be that environmental risks, rescue, anti-smuggling, anti-terrorism are addressed by different organisations with their own ROC and NOC structure but that they use the same contributing assets (layer 1) and the same infrastructure (layer 2). As explained further down in the description such user specific services can easily be implemented in an embodiment of the invention based on the definition of worksets. But other implementations may be possible. Examples of core services which may be provided to all classes of users (even if access to the information itself may be restricted) are: map and geographic information system (GIS) support; voice on IP (VoIP); messaging and alerts broadcast. An essential part of the core services is the Common Operational Picture (COP), the building of which is explained with further details herebelow; in essence, the COP gives to the users awareness of "who is where" and of "who is doing what" in any maritime sector ("who" being declared or detected), with possibly a number of flags for different threat levels calculated according to the invention; the COP may include ship and geography-indexed context information split between permanent information (e.g., ship characteristics, shipping lanes, etc.), semi-permanent information (i.e., with a non-real time refreshing cycle such as cargo, journey, meteorology, zoning, etc.) and instant information (e.g., messages, pictures, etc.).

This architecture is well suited to implement the processes to compute the threat levels from the output of the correlation processes described hereinabove.

Figure 4A:
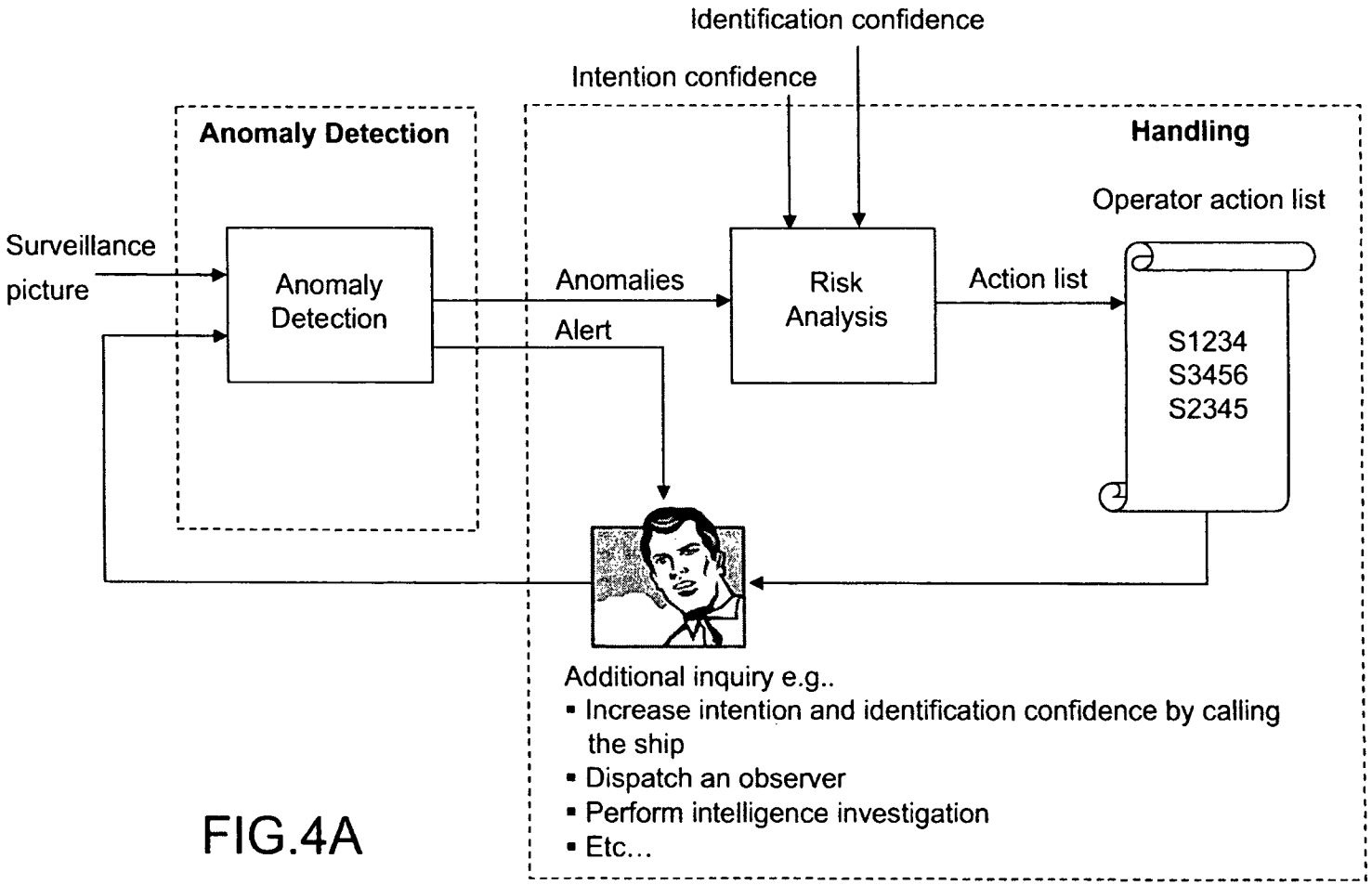
Figure 4B:
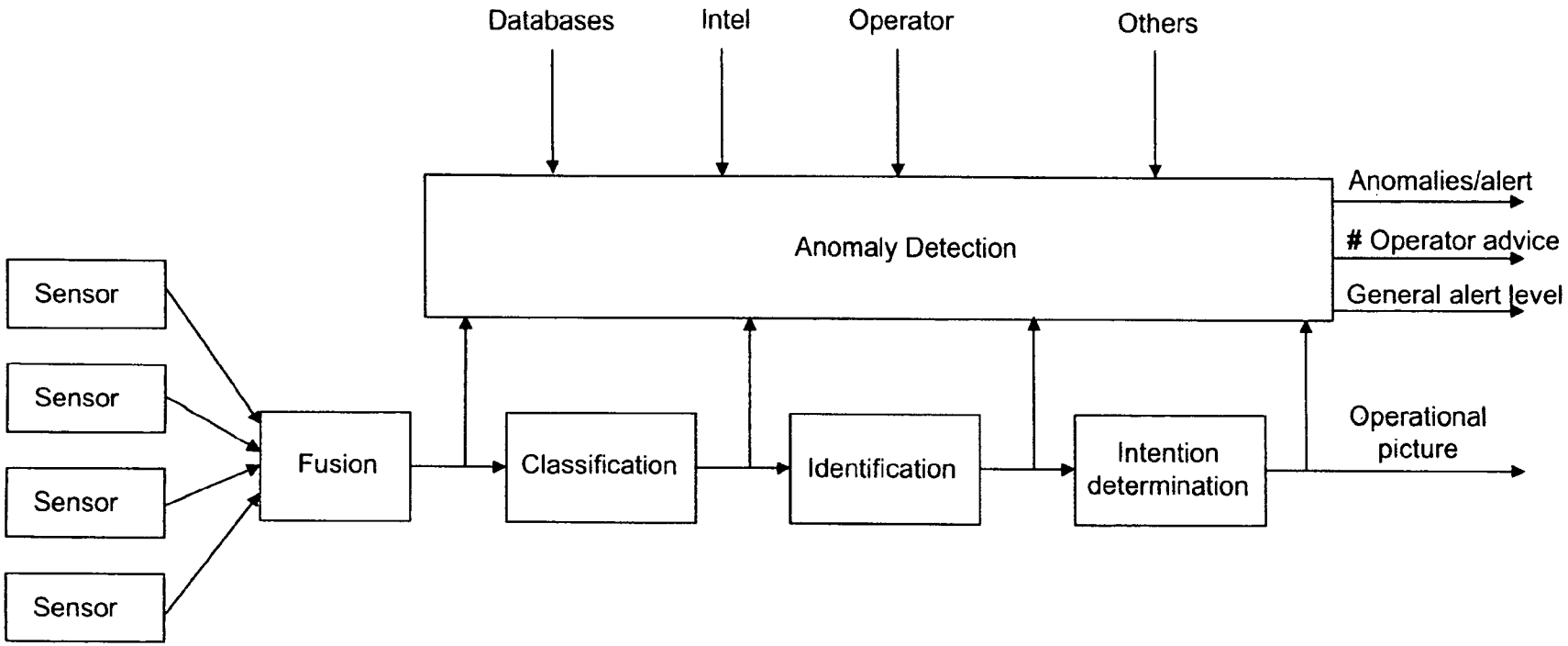

More than one process can be used, independently or in combination, to analyse the level of threat to be attributed to a track. A logical sequence of a first type of process based on the detection of deviations from standard behaviours is pictured on FIGS. 4A, 4B and 4C. As seen on FIG. 4A, the overall operational sequence includes an anomaly detection function which triggers in parallel an alert function and a risk analysis function. This risk analysis function in turn triggers an action list. One of the actions systematically on the list is additional inquiry which loops back on anomaly detection to either confirm the alert or cancel it, and in this case possibly update the parameters which have triggered the anomaly. Examples of anomalies include: a ship is in the wrong place; a ship sends out incorrect AIS information; a fishing boat is fishing in an area where, from intelligence, it is known there is no fish; a ship has never been seen before in a certain location with that specific speed; a ship does not follow the historical patterns. Examples of types of additional inquiries are: call the ship; dispatch an observer; perform intelligence investigation. As Illustrated on FIG. 4B, the anomaly detection function includes a variety of independent subfunctions which all have the same purpose, i.e., detection of abnormal track behaviour. Abnormal behaviour can be an indicator of a terrorist attack, a drug smuggling activity or other illegal activity. This qualification triggers an action to take a closer look. The subfunctions operate with different inputs and time scales. In addition to a list of anomalies the process produces a measure of the amount of work an operator has to do. In a very confusing situation, the system will advise to add a new operator. There may be situations where the absence of information can trigger an alert. An example is a perfect fishing day with no fishing boats. This will trigger a general alert, not track related. As illustrated on FIG. 4C, anomalies in the input data are detected by means of different agents working with different input data and working on a different time scale. Sometimes, the timescale is direct (for instance a track violating an area). Other times the timescale is longer (for instance, fishing boats are missing in the surveillance picture). All anomaly detection agents deliver indicators which may be based on likelihood vectors and analysed by means of a reasoning engine. The input of the reasoning function are the indicators provided by the different agents. For example the appearance indicator is a likely hood vector for strangeness based on the appearance of a track. The reasoning engine is also provided with mapping matrices. An example of mapping matrices is given by FIG. 4D. These matrices provide the relation of an indicator with the estimations. The observation for example track appearance is expressed in probabilities P(e|normal) and P (e|¬ normal). In other words, the probability that the event is normal and the probability that the event is not normal. From this indicator the estimation is derived for anomaly=P (e|A). This is done with the aid of mapping matrices.

The definitions of the mapping matrices are:

P(normal|A) Probability that a track with a high anomaly indication has a normal appearance indicator.

P(normal|¬A) Probability that a track with a low anomaly indication has a normal appearance indicator.

P(¬normal|A) Probability that a track with a high anomaly indication does not have a normal appearance indicator.

P(¬normal|¬A) Probability that a track with a low anomaly indication does not have a normal appearance indicator.

The estimation for anomaly for the appearance indicator is:

$$P(e|A)=P(e|\text{normal})*P(\text{normal}|A)+P(e|\neg\text{normal})*P(\neg\text{normal}|A)$$

$$P(e|\neg A)=P(e|\text{normal})*P(\text{normal}|\neg A)+P(e|\neg\text{normal})*P(\neg\text{normal}|\neg A)$$

In this way for each of the indicators of the different agents an anomaly estimation is derived, called $$P(e_1|A),P(e_1|\neg A)*P(e_2|A),P(e_2|\neg A),P(e_3|A),P(e_3|\neg A),\text{ etc}$$

The conversion of the different anomaly estimations to a single estimation is done according to:

$$P(e|A)=P(e_1|A)*P(e_2|A)*P(e_3A)*\text{------}*P(e_n|A)$$

$$P(e|\neg A)=P(e_1|\neg A)*P(e_2|\neg A)*P(e_3|\neg A)*\text{------}*P(e_n|\neg A)$$

The normalized estimation=P(e|A)/(P(e|A)+P(e|¬A))

Example results are given in the table below:

| Indicators | Observation | P(A) | P(not A) |
|---|---|---|---|
| Appearance | Normal | 0.25 | 0.8 |
| | Unlikely | 0.75 | 0.2 |
| Kinematics | Long | 0.25 | 0.8 |
| | Very short | 0.75 | 0.2 |
| In area | Not in area | 0.3 | 0.9 |
| | In area | 0.7 | 0.1 |

The result represents the probability of abnormal behaviour for this track with these indicators.

It is also possible to assess a general alert level. This estimation is a general measure of difficulty of the tactical situation. For example in case tracks are maneuvering around the ship or many deviations with the history footprint is detected. Another strange situation is when a complete class of targets is appearing or just missing compared to the history footprint information.

Input indicators for this estimation are:

Confusion This is an indication for the difficulty in the tactical situation.

Environmental Indicator for the environmental situation

History Indicator for the difference with the situation on a normal day

In case there is an unexpected difference in the tactical situation (for example the fishing boats are missing, or crowded with tourists, etc)

Confusion inputs are:

Mean appearance Mean value of appearance strangeness of all targets.

Mean kinematics Mean value of kinematics strangeness of all targets.

Areas Total value of all tracks, which are present in the defined areas.

Environmental inputs are:

Sea state

Visibility

History inputs are:

Track type deviation: indicates for each track type the strangeness with a normal situation.

In an embodiment of a system according to the invention, the anomaly detection function can be performed from input by one of the following subfunctions or agents: validity check of AIS information; violation of an alert area, a warning area, a keep out area; kinematics investigation; history footprint evaluation; tactical risk analysis; deviation from route plan; trade pattern analysis; rendez vous recognition; reaction elicit; deviation from standard track. Other agents may be added to this list but will nevertheless fall into the scope of this invention if they work from correlation of instant-track and non-instant track data and determine a threat level of a target. Inconsistency of AIS information can lead to an increase in the threat level assigned to a track. Some examples of controls to be performed are: ships type versus length and beam; declared Port Of Departure (POD) and Port Of Arrival (POA) usually not connected by a commercial route; feasibility of destination and ETA with respect to ship's type; ETA shift (A ship's AIS is switched off for a time and the average speed of the whole journey differs from data computed before and after blanking); IMO number versus type of ship and ship's name; AIS position versus radar position; course versus route plan; speed versus ship's type; rate of turn versus ship's type; navigational status versus position and ship's type; hazardous cargo versus position and destination. Before triggering an increase in the threat level assigned to a track, a second control should be run against logical explanations of an inconsistency, for instance: configuration errors; faulty working of GPS equipment; old GPS equipment; wrong position due to multi path effect—especially in harbours. Inconsistencies will be flagged, possibly above a user defined threshold.

Figure 5A:
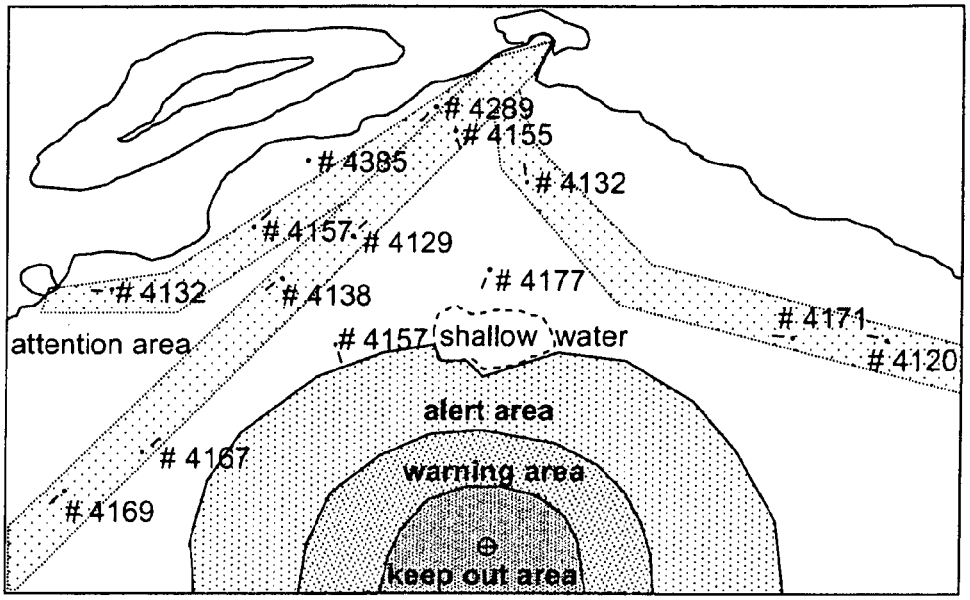
FIGS. 5A and 5B illustrate the operation of a violation of designated area function in an embodiment of the invention.
Figure 5B:
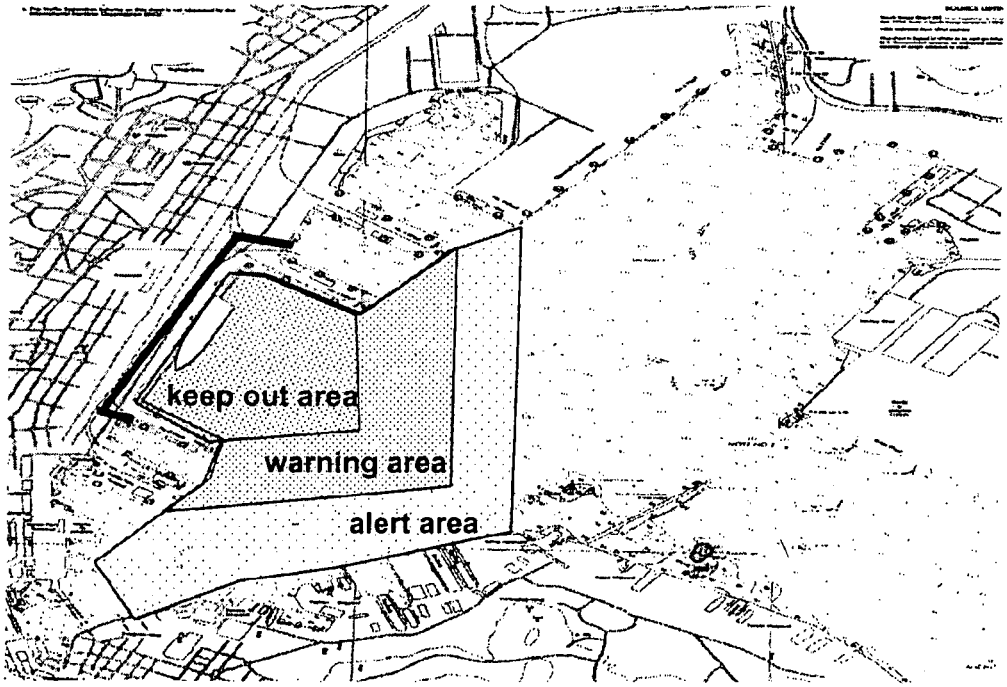

A second anomaly detection process is run against preset areas. As illustrated by FIGS. 5A and 5B, the user can define alert areas, warning areas and keep out areas. The areas can be referenced to a fixed place or to a moving object. An alert is triggered when any track or a track which is qualified as belonging to a preset list of classes of tracks enters the predefined area. Such event will trigger different types of actions depending on the area which is violated. An alert area violation will only trigger a signal to the operators in the ROC. A danger zone violation may send a message to intervention means in said zones. A keep out area may trigger automatic intervention of deterrence or combat means.

A third anomaly detection process is the kinematics investigation process pictured in FIG. 6. In this subfunction, three aspects of a track are investigated: what is the average behaviour? Is there a significant change? What is the forecast of the track? In other words, the current and future of the track are investigated. This investigation involves the following actions: average track evaluation (for a determined class of tracks); current speed/course evaluation; collision Closest Point of Approach (CPA) calculation. Average track evaluation compares the average kinematics of a track for a class of vessels selected from DB1 (Kinematics intelligence) as matching the class of the DB2 track. For each class, information is available concerning the "expected" kinematics behaviour. For example, when a vessel belonging to the class of fishing boats has an average speed of 10 knots and a maximum of 25 knots, an average speed of 20 knots for a track classified as a fishing boat track triggers an increase in the threat level for this track. The current speed/course can be evaluated with respect to the track history in order to detect kinematics changes. In combination with the kinematics intelligence information, an observed change can be indicated as significant or within normal behaviour. An airliner making a manoeuvre with a 2 g acceleration will be considered as abnormal whereas the same manoeuvre by a combat fighter will be considered as normal. The current kinematics can also be compared with the boundary limits of a class of tracks.

Figure 7A:
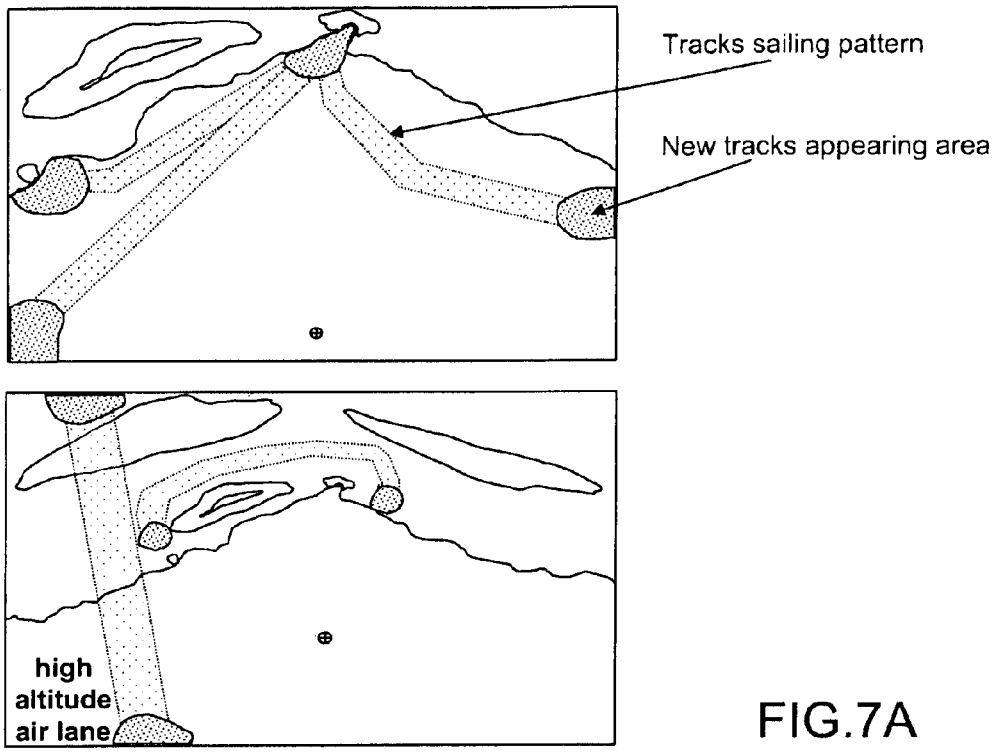
FIGS. 7A and 7B illustrate the operation of an analysis function of history footprint of tracks according to an embodiment of the invention.
Figure 7B:
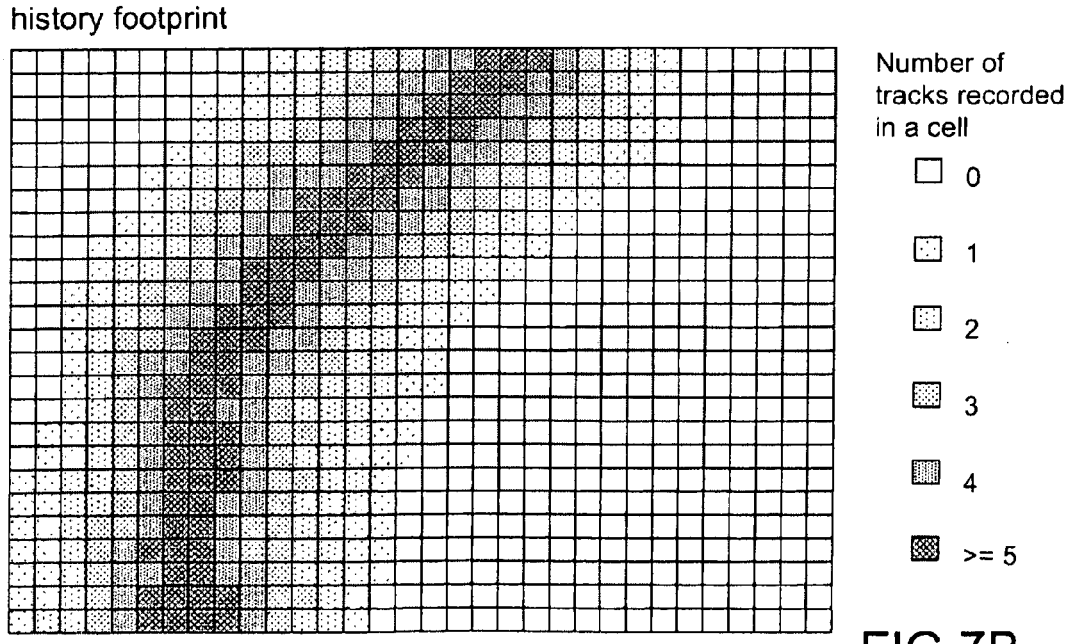

A fourth anomaly detection process is the footprint history of tracks investigation process which is exemplified by FIGS. 7A and 7B. This is a means to capture and learn the normal behaviour patterns and compare the actual behaviour of a track against the normal behaviour based on history. For example, it is known at which positions tracks normally appear for the first time (harbour or surf beach); A track which will first appear at an other location will be considered abnormal (see FIG. 7A). To compare behaviour of a track with the local patterns, a footprint is created and stored in DB2. This footprint (see FIG. 7B) is a digitised map, called history footprint, that contains information on the tracks observed in the area of interest. The area is split in square cells, for instance of 250 meters length of side. Each cell contains for example information on averages and standard deviation, number of track appearances, speed, course and initial track appearances. This information is provided for each class of vessel (merchant, fishing, sailing or other type of boat). The history footprint of tracks is automatically maintained by the storage of historic track data process and does not require any support by the operator. The history footprint contains information from all tracks in the area of interest and is thus a dynamic source of intelligence. The system provides indications on the maturity (number of changes) and run-in (number of measurements higher than a threshold) status. The historic track data is used to determine the following indications: the probability that tracks can be present at a certain position; the probability that tracks can be seen for the first time at a certain position; the normal kinematics position at a certain position. The process compares current kinematics with history footprint and determines: track appearance (how strange is it to find a track on a certain position, based on a comparison to the number of tracks recorded in the history footprint); initial track appearance (how strange is it to detect a track on a certain position, based on the detection areas recorded in the history footprint); course appearance (how strange is a track course on that position, based on the mean course and standard deviation); speed appearance (how strange is a track speed on that position, based on a comparison to the mean speed and standard deviation).

Figure 8A:
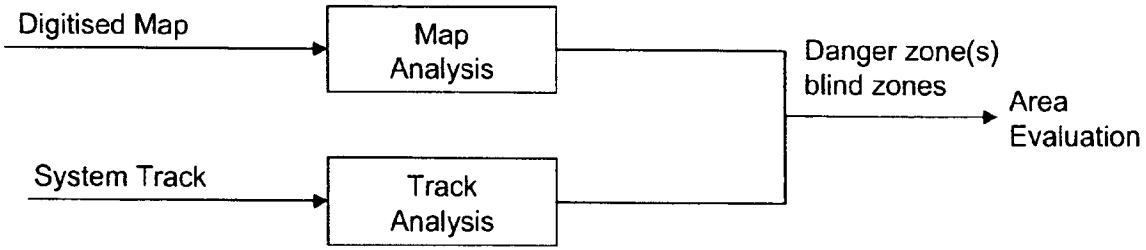
FIGS. 8A, 8B and 8C illustrate the operation of a tactical risk analysis function according to an embodiment of the invention.
Figure 8B:
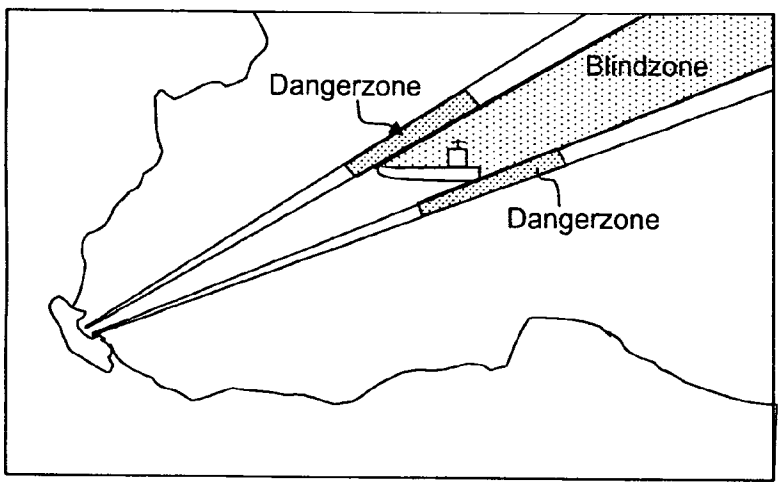
Figure 8C:
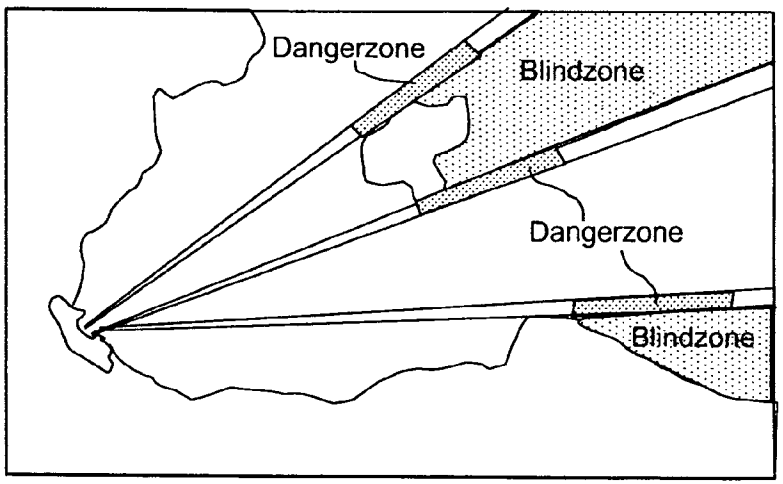

A fifth anomaly detection process is a tactical risk analysis illustrated by FIGS. 8A, 8B and 8C. If we take the example of a terrorist attack, it will likely be performed under cover of natural or opportunity objects so that discovery of the attack is as late as possible. Behind these objects, the probability of detecting a track is indeed much smaller. The area behind such an object is identified as a blind zone. Once the track leaves the blind zone, it is in open sight and visible to the sensors. This is why the system systematically allocates danger zones around a blind zone. The objects used as blind zones can either be a track or a part of the natural environment. A specific process is run for each kind of objects; all processes are based on map analysis and track analysis. Map analysis is based on available digital nautical and land maps. When a blind zone such as a mountain is detected, the area next to the blind zone is marked as a danger zone. The size of a danger zone is determined by default settings. When a track is observed, the track analysis process evaluates if this object can be used as a cover by an other object. The undercover track may be behind the first object, masked either physically or electro-magnetically. One or more danger zones can be defined for one definite track.

A sixth anomaly detection process is the deviation from route plan. This is of course only available for targets which have transmitted a route plan. Transmission will generally be made through the AIS as indicated hereabove. The process compares the track's expected and actual position. Deviation can be a difference in time (the track is correct but delayed because of late departure or of difference in conditions en route). It can also be a difference in position whereas the route was followed with timeliness up to a moment in time.

Figure 9:
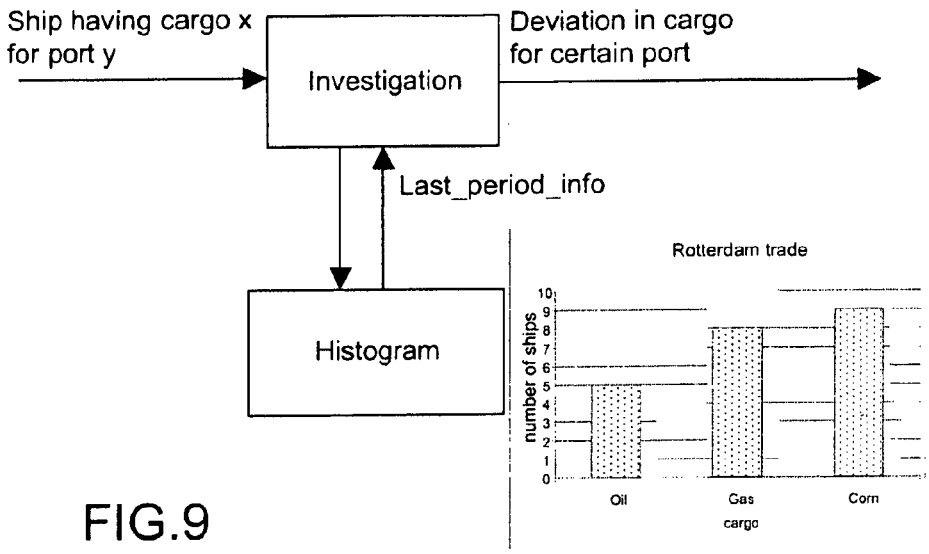
FIG. 9 illustrates the operation of a trade pattern analysis function according to an embodiment of the invention.

A seventh anomaly detection process is trade pattern analysis. This process is based on comparison of instant-track data with trade patterns stored in DB2 for a number of classes of vessels carrying a certain cargo. As illustrated on FIG. 9, the system produces a histogram comprising harbours of origin and destination, cargo, number of ships carrying this cargo. The histogram is season dependent to reflect the fact that trade is itself seasonal.

An eight anomaly detection process is rendez vous recognition. This functionality determines the probability of tracks having a rendez vous. A rendez vous at sea can be used by drug smugglers to load drugs from a larger ship to a smaller ship which can more easily approach the coast or transfer its cargo to an other ship. A rendezvous is likely in one of the following circumstances: ships are close together; ships have same speed; ships have same direction; speed decrease and/or course change at a passed place of an other track.

A ninth anomaly detection process is reaction illicit. In cases when an operator dispatches an observer to a certain location in the form of an own asset (e.g., inflatable boat, helicopter, airplane, navy ship, etc.), the system supports the operator in evaluating the reaction of tracks. A normal reaction is no behaviour change at the sight of a patrol vehicle. A change in behaviour (e.g., change or course or speed) is prima facie considered abnormal.

A tenth anomaly detection process is deviation from standard track pattern. Classes of vessels follow different types of tracks. For instance a fishing boat follows known trajectories of fish; a ferry has fixed trajectory and timetable; a sailing boat tacks against the wind. The track of a target which is deemed to belong to a class with a standard track pattern will be matched with the standard and deviation will be analysed. To perform this function, classification of the target through sensors may be aided by other correlation processes such as: height of the vessel from distance of first appearance; ship's position with reference to the history footprint; lack of AIS information, etc.

After an anomaly detection process has been performed, a risk analysis process is run. This process analyses the potential damage in case a track has hostile intentions. This will be combined with the confidence level of identification and intention. For example, if it is a known vessel which has been checked with certainty as having no chance of having been hijacked because of non ambiguous recent radio contact, the threat level concerning explosion will be marked as low, even if the level of damage possibly caused in case of explosion may be very high. The output of this process is a list of tracks ranked by threat level for each category of threat (law violation of a number of types; terrorist attack; environmental hazard, etc.). Each category may be awarded a different weighting in different circumstances (ie: intelligence reports drawing attention to specific possible events, general alert level based on expected threats, etc.) and the list will vary accordingly. Highest priority threatening tracks will deserve a closer investigation to reach a higher level of confidence for identification, intention and background information. The operator in the ROC will be thus able to focus on priority task and select more easily one of the confirmation actions at his disposal: call the ship by radio; dispatch an observer; perform intelligence investigation.

As already mentioned, anomaly detection processes may be performed either individually or sequentially or in parallel. In the last two cases, results from each of the individual anomaly detection agents and risk analysis processes will be combined using the reasoning engine described hereinabove.

Figure 10A:
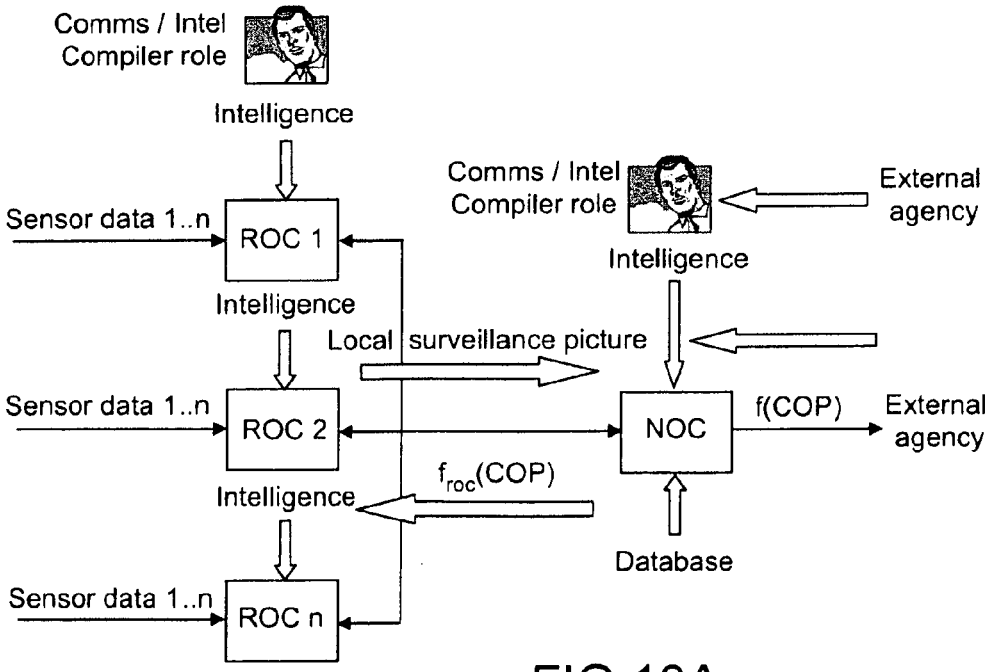
FIGS. 10A, 10B and 10C illustrate the operation of an intelligence handling function according to an embodiment of the invention.

An other category of threat level analysis process is based on intelligence reports and information extracted therefrom. Handling of intelligence information and use in the threat level analyses process may vary greatly from one embodiment to an other for different reasons, significantly determined by the organisation of the security and safety functions in the country where the system is deployed. FIG. 10A illustrates a system with a number of ROCs (ROC1, ROC2, . . . ROCn) coordinated by a NOC with external agencies providing intelligence information at various levels (Regional, national) and Comms/Intel Compilers tasked with handling the intelligence information. As already mentioned, intelligence reports may be manually input in DB2 or the data records to be stored in this database are automatically extracted from the reports using algorithms dedicated to information extraction from a structured or unstructured text. In the context of automatic extraction, the Compiler will be tasked with setting the parameters and controlling the confidence level of the results of information extraction.

Figure 10B:
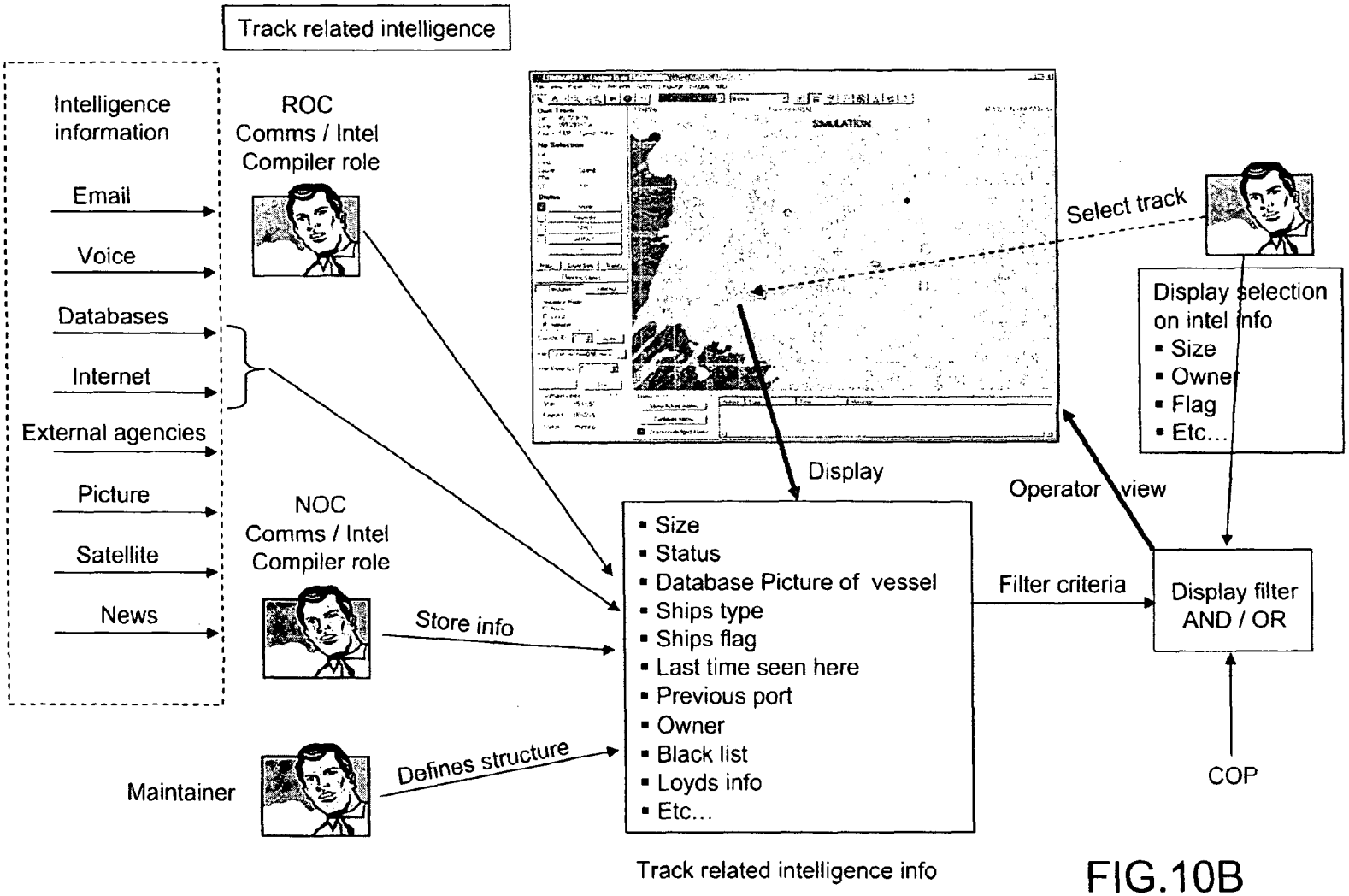
Figure 10C:
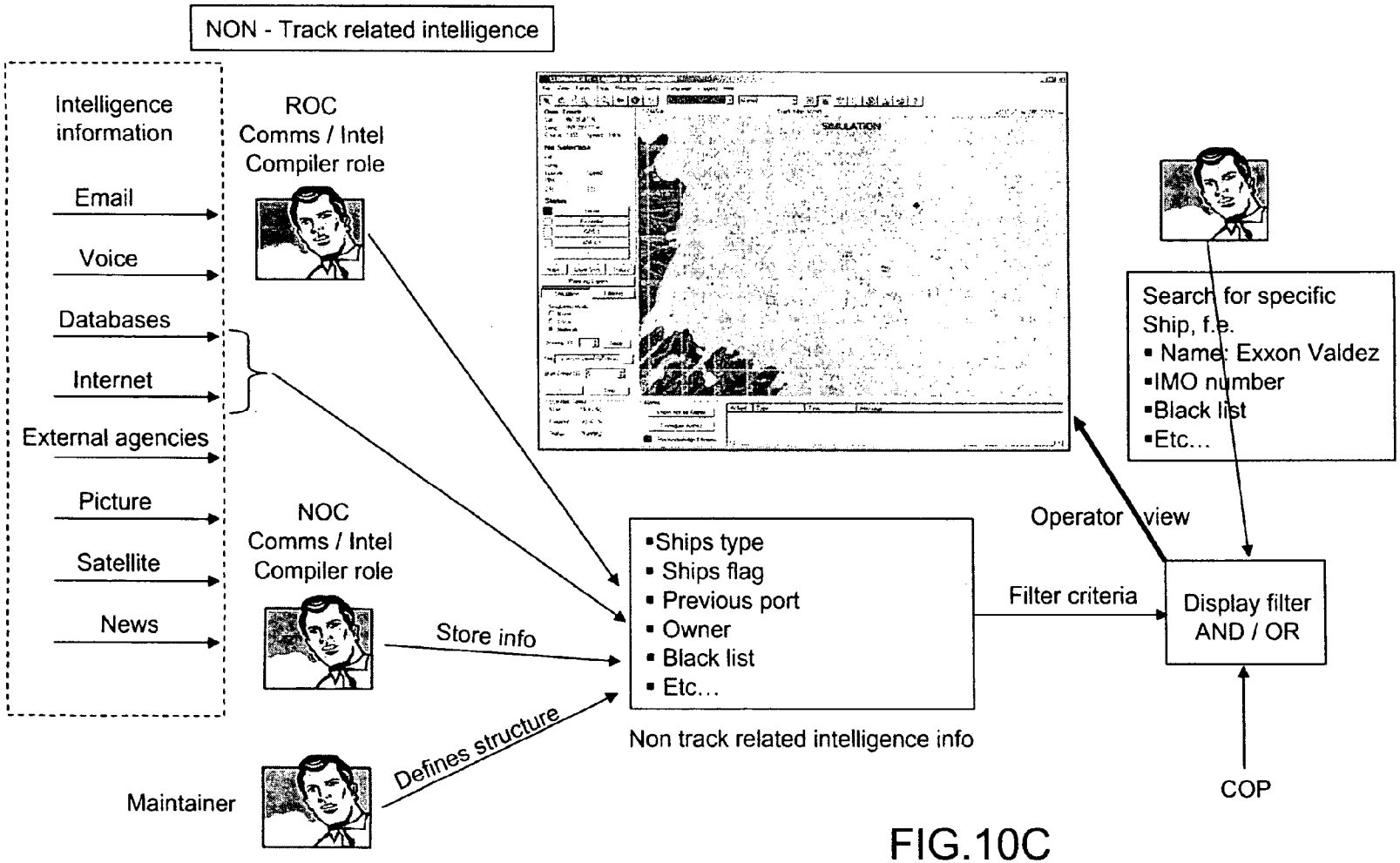

The intelligence sources may be quite diverse: e-mails, voice, internal or external databases, Internet, external agencies, pictures, satellite images, news. From a system design point of view, the main consideration will though be to know if the intelligence data to be used is track dependent or not. Handling of track related information is illustrated on FIG. 10B. Each track in DB1 is linked to a structure in DB2 where the intelligence information for the correlated track is stored. The definition of this structure is done by a maintainer who has one of the roles defined in ROCs and NOC (see herebelow). In this instance, links between tracks and related intelligence data will be established. Information linked to tracks may be filtered on any of the stored datafields (e.g., source of data; freshness; category of threat, etc.). Handling of non-track related intelligence is illustrated on FIG. 10C. Normally, this category of data provides more background information about the tactical situation. Some examples are: fishing boat "Free Whilly" is stolen; drug transport reported; look out for tanker Exxon Valdez. The operator can paramaterize an automatic query or define it manually to search in DB2 for certain information defined as alert parameters, for example: type of unlawful or threatening events supposed to occur in the monitored area in a time window; all suspect vessels, suspect vessels of a certain type. And the results of this queries will be linked to the corresponding tracks which match the fields of the intelligence. Of course, non track related intelligence information is time dependent and should be withdrawn when outdated.

The threat level may be then computed based only on the intelligence data linked to the tracks or based on this data in combination with any or all of the anomaly detection processes described above. Possible combination is also performed by a reasoning engine, considering the various sources of intelligence deemed relevant for the track as an agent which output indicators to the engine.

Figure 11A:
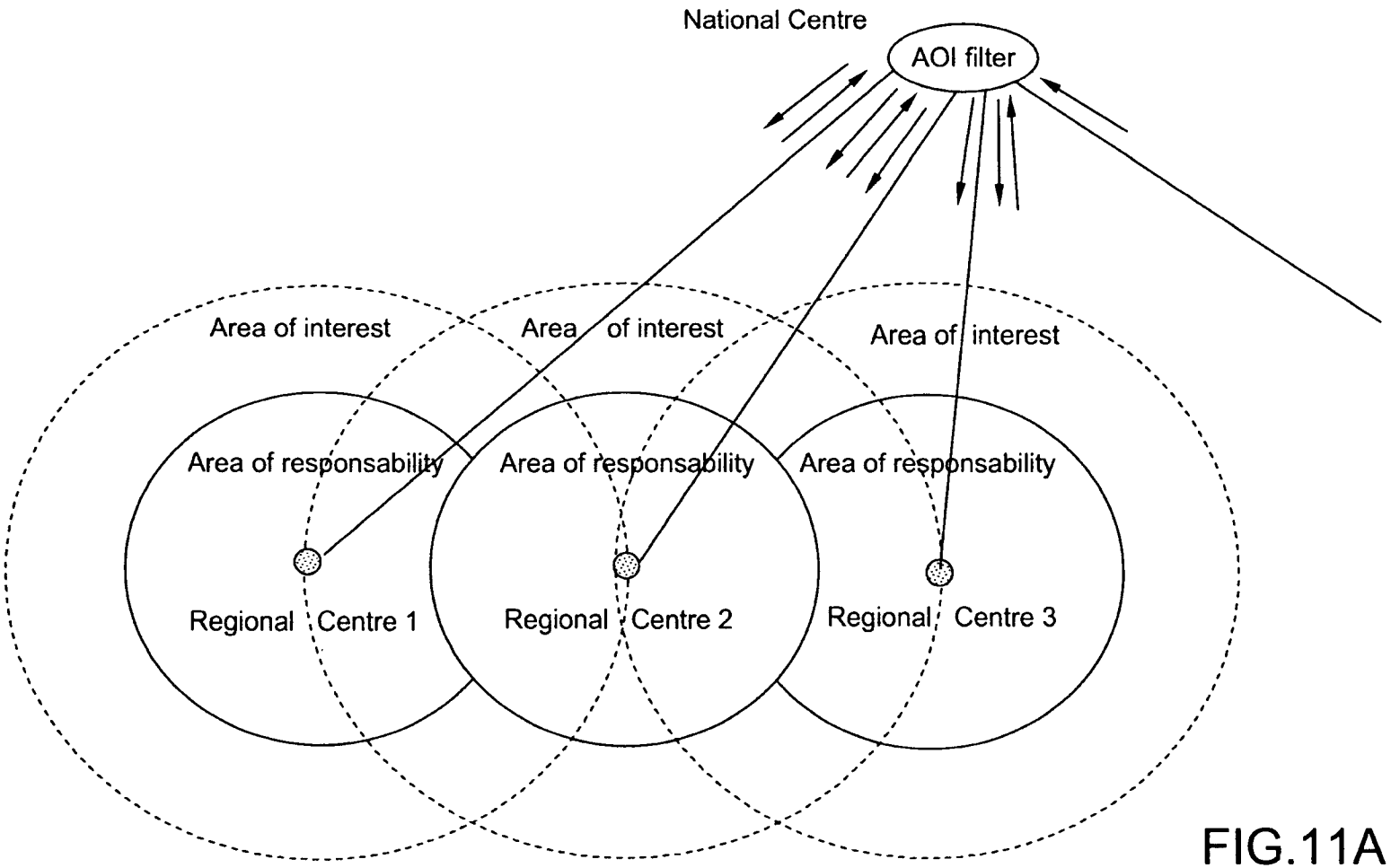
FIGS. 11A and 11B illustrate the operation of the intelligence distribution function according to an embodiment of the invention.
Figure 11B:
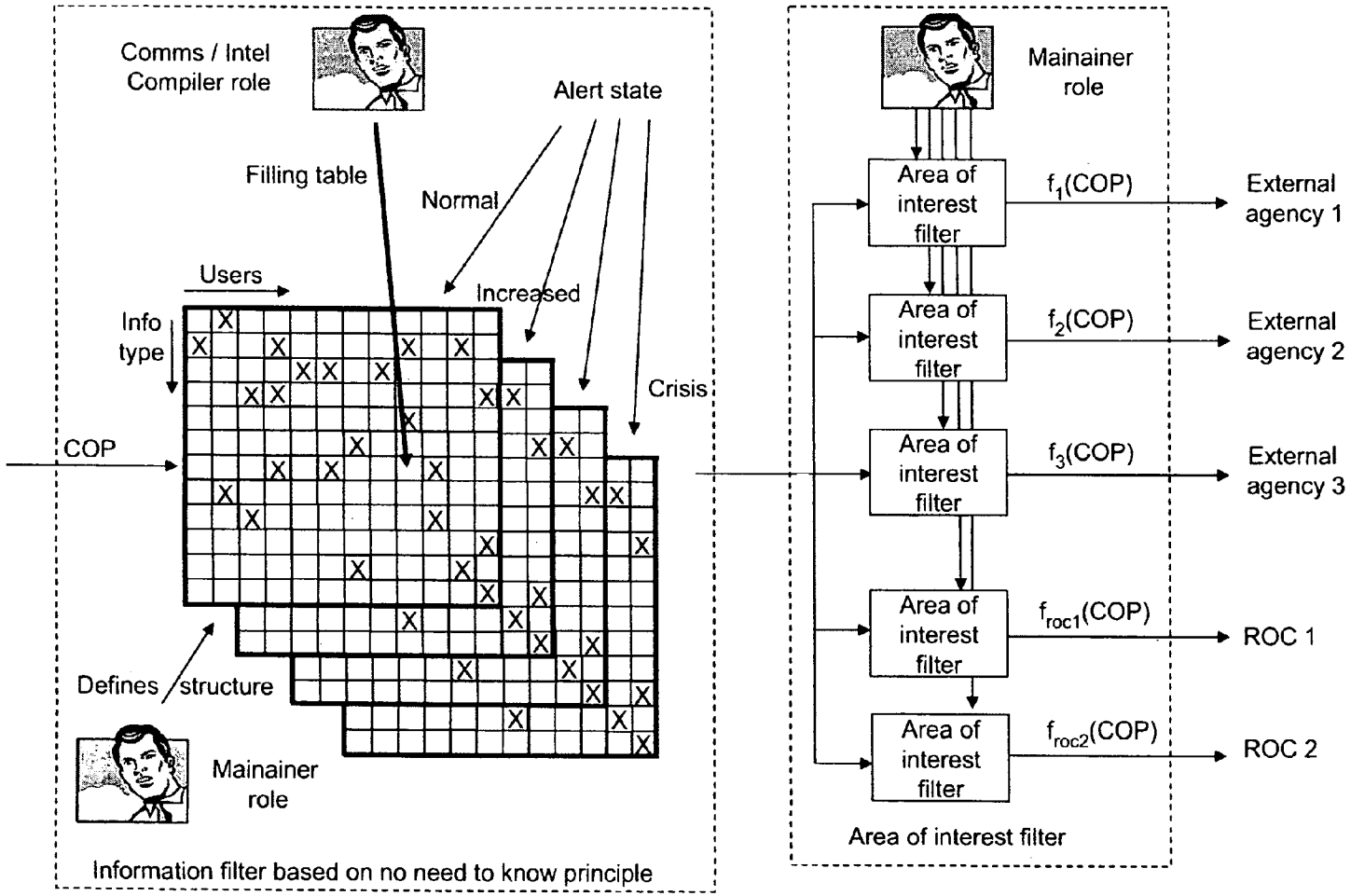

When handling intelligence or other kind of sensitive data, it is important to implement distribution rules which are defined by the supreme authority controlling the system. In specific embodiments of this invention, distribution rules are defined based both on geographic criteria which define areas of responsibility and areas of interest and on attributes of the data itself. The geographic criteria are illustrated by FIG. 11A. Areas of interest are overlapping because information about incoming vessels may be of interest for more than one ROC at a time, even though responsibility for the actions to be conducted will be for only one of these. Each area of interest is defined by a polygon and the corresponding distribution policy is implemented by means of a filter. The information attributes filter is illustrated by FIG. 11B. The filter is based on a matrix with the list of system's users as first coordinate and a list of information attributes as a second coordinate. Relevant information attributes may be themselves the crospoints of an other matrix comprising as a first coordinate the information type and as a second coordinate the information source. Indeed, some intelligence sources only accept to distribute their information upon condition that its distribution be controlled even within the organization of an allowed recipient. The filter is implemented based on the combination of matrix cells. The matrix cells may include dynamic values defined as a function, for instance, of operating modes. Areas of interest and selective distribution thus will be different between a standard monitoring mode, a general alert mode and a crisis intervention mode. Other dynamic distribution rules may be defined.

When the threat level analysis process has delivered its results, the data set to build the Common Operational Picture (COP), 200A is complete. The COP is a computer composed area operational picture. It is to be noted that the COP building process is a dynamic process. A first COP will be ready to be presented to the operators even before all correlation and threat level analysis processes have been completed. The COP is updated either when fresh results are available or periodically. A user defined variable may set the level of change in the key parameters of each situation which will trigger a refreshment of the COP, so that the rate of change does not create instability of data and displays. An other user defined variable may set the minimum threat level to be presented as part of a COP as a function of the available computer and display capabilities.

Figure 12A:
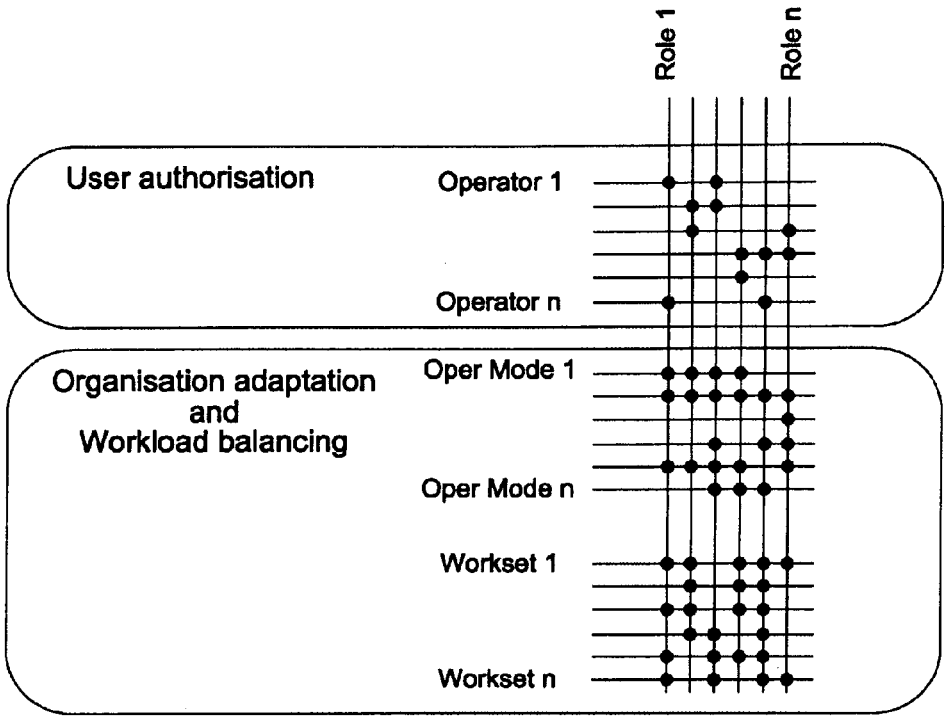
FIGS. 12A and 12B illustrate the organisation of the worksets according to an embodiment of the invention.

In one of the embodiments of the invention, subsets of the COP will be presented in screens to various types of operators at ROC and NOC levels. As will be further explained when presenting the design and specification method to build a system according to the invention, the roles of the operators are a key element which defines a list of tasks to be accomplished by various operators with attributed roles to fulfill a mission. The design of the screens is derived from the Concept of Operations (CONOPS) which outputs a number of Operating Modes and a Manning Concept for operating the system. Based on an Operational Mission and Task analysis, Operators Roles are defined and then mapped to the applicable Operating Modes. The CONOPS also defines a mapping between the Operators Roles and the Operational Tasks. Based on this mapping, System Functions are allocated to the Operators Roles, thus defining which operator will need which functions. In practice, authorisation issues may imply that certain information and functions are restricted to specific Roles or even limited to specific operational circumstances. All these factors determine the Worksets parameters 300A. Consequently, the operational analysis also gives insight in when an operator needs the information and system functions. Despite all efforts during this initial analysis, daily practice may show that the workload is not balanced enough among the Roles. Also, the organisation may change over time and introduce new Roles or change responsibilities of existing ones. For these reasons, the system according to the invention includes a number of flexible mechanisms to be tuned to a new organisation, new authorisation requirements or a new division of tasks between operators. In a standard mode, users of the system have to login by user name and password. These can be replaced by a smart card with a pin code or with a biometrics access control device (fingerprint, face or pupil recognition or the like). Pin code and biometrics may also be combined. Whichever access control procedure is performed, the login determines which Roles can be performed by the operator. After login, the system allows the user only to select one of the Roles for which he is authorised. The system allows the flexible definition of this user authorisation. When a user has selected a Role, the system configures his working environment by providing a number of Worksets. Each Workset is a coherent set of functions and information that a user needs to fulfil a specific task or set of tasks. These functions are arranged on the screen in a way that fits the workflow of the supported tasks. The system allows the allocation of Worksets to Roles. The organisation may use the system in different Operational Modes, like Normal Mode, Emergency Mode, Training Mode and Maintenance Mode. The selected Operational Mode determines which Roles are available on the system and which are not. The number of Operational Modes can be extended by defining a new Operational Mode and allocating a set of Roles to this mode. This allows the authority managing the system to predefine organisational configurations for various kinds of operational situations. Using this mechanism, illustrated by FIG. 12A, the organisation can adapt itself to the current workload. In different Operational Modes, the Allocation of Tasks to Roles (and thus of Worksets to Roles) may differ in order to always distribute work over operators in a balanced way. The flexible organisation of the system allows workload balancing by selection the appropriate action state, adding extra operators using spare consoles or selecting different roles that provide the required division of tasks in the current situation. Information that is used for these decisions can be for instance: current number and type of tracks in the area of interest; current number, size and nature of current incidents; anticipation based on time of day (historical data about expected number of tracks and incidents); anticipation based on intelligence data (expected type and size of incidents). In heavy duty centres, this work load balancing function will itself be a defined Role with an attributed Workset.

Figure 12B:
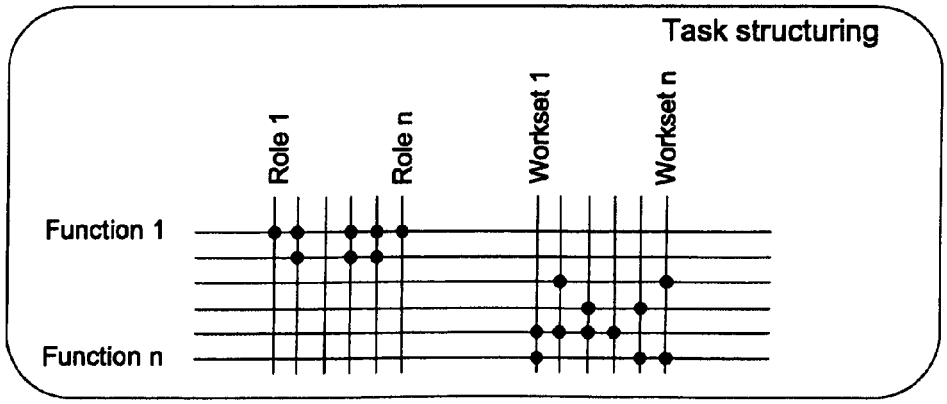

Functions can be allocated to Worksets. In this definition, the screen positions of main windows and sub-windows can also be specified. Display of function on a screen can be set to be either automatic or manual. In a different embodiment, functions can be allocated directly to a Role and selected independently of the current Workset. These different modes of allocation of Worksets are illustrated on FIG. 12B.

Figure 13:
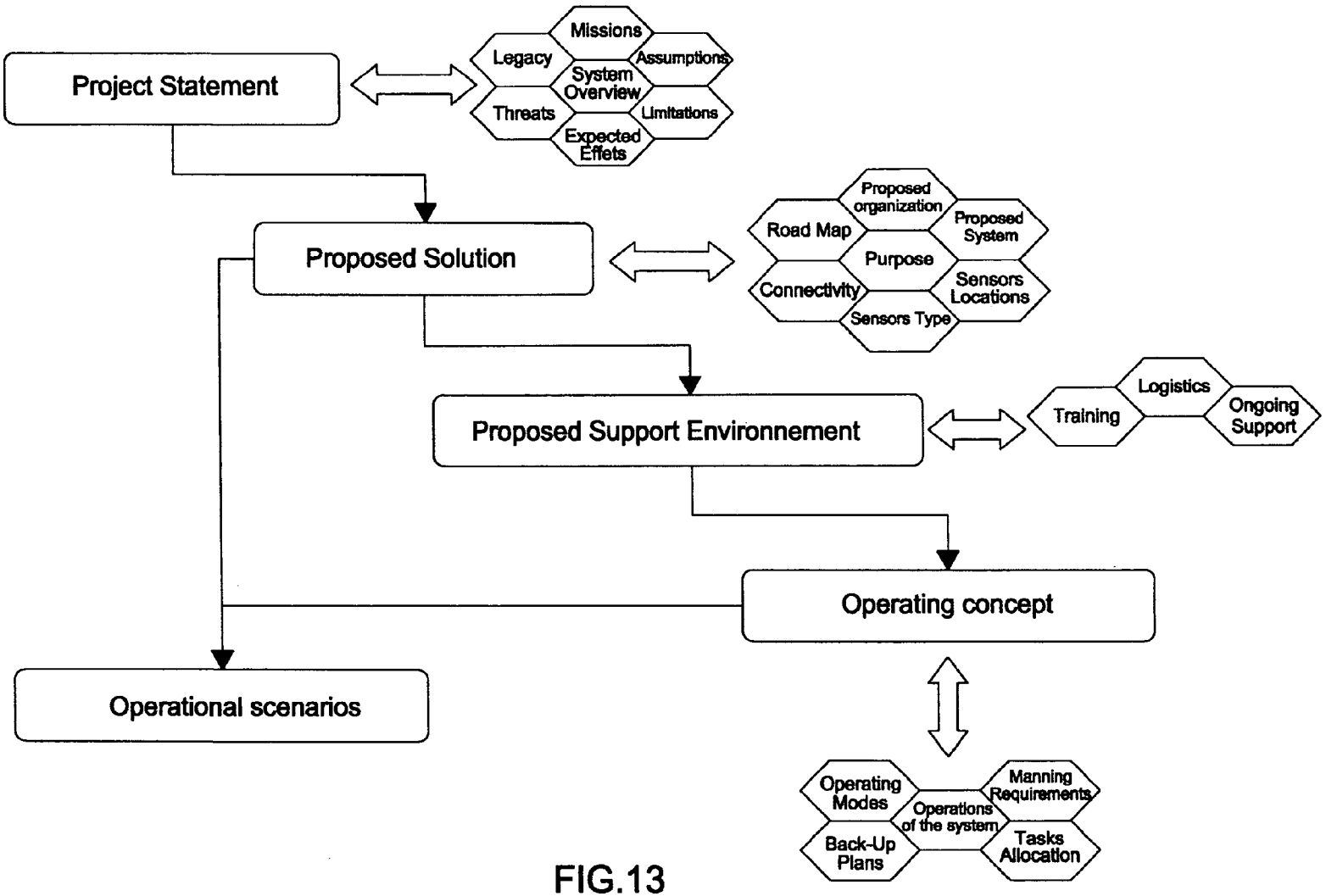
FIG. 13 is a logical diagram of the specification method according to the invention.
Figure 14:
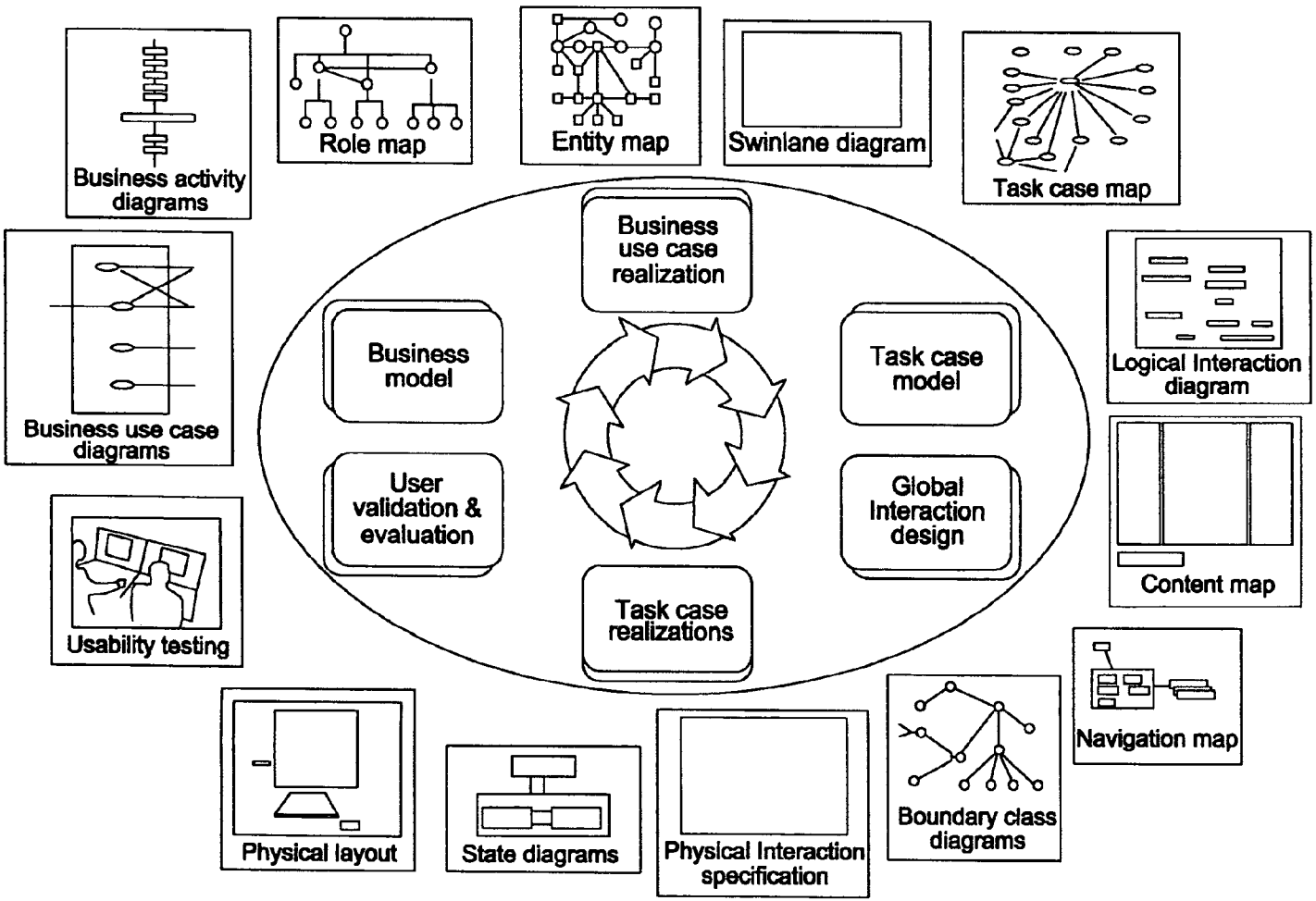
FIG. 14 illustrates the specification of area operational picture displays according to an embodiment of the invention.

FIG. 13 illustrates the method whereby the invention is best specified and designed. This method is based on a Concept of Operations (CONOPS) approach but is unique in the sense that it brings together all operational and high level technical aspects that are important to the users of the system for them to be able to judge the proposed system on criteria such as: suitability for all intended purposes; coverage of all intended purposes; organisational consequences of the introduction of the system; manning requirements; training and logistics efforts. In a specific embodiment of the method according to the invention, the CONOPS documentation includes the items listed on FIG. 13.

The main chapters of the CONOPS, which can be seen as many phases or steps of the specification of the system, will be: the Project Statement, the Proposed Solution, the Proposed Support Environment, the Operating Concept and the Operational scenarios. Other wording may be used for instance if the method according to the invention is used to describe an existing system as a way to reverse engineer its specification in the context of an evaluation of its operative efficiency before a decision is made to amend or redesign the existing system.

It is to be noted that different detailed processes may be used to collect the inputs needed to feed these chapters, derive conclusions and have them validated by authorised representatives of the users. Information to be input can be collected either through a questionnaire, through face to face or telephone interviews. It can be also directly input by the users into a computer system provided with adequate interface and controls. The output will be generally produced manually by the system designer staff. But some output, like graphics built directly from the input, can be produced automatically. Validation can also be done through interview or input of some of the users into a computer system. There is a logical order to be used to perform the steps of the method, which is described on FIG. 13. The order is mostly sequential, with the caveat that the Proposed Solution can be fine-tuned after the users have reviewed the Operational Scenarios. In the description of the steps of the method according to the invention which follows, "subsystem" should be understood as comprising sensors, VTS, VTMIS, Links and control centers.

The Project Statement step includes sub steps such as:

Missions: all the missions for which the organisation in charge of the system is responsible;

Current situation: Organisation (current structure of the organisation and relations with external organisations that are involved in fulfilling the Missions; Legacy equipment (overview of the current infrastructure and equipment that are available and should possibly be integrated in the new system); Own Assets (overview of the currents assets which are available or which will be purchased independently by the organisation); Environment (environmental aspects like Climate and Geography); Background (relevant political and industrial aspects); Operational situation evaluation (geographically related overview of areas and threats that are important with respect to the identified Missions); Assumptions (made for the Proposed solutions); Limitations (scope that apply to the Proposed solutions, for instance exclusion of some areas); Expected effects (benefits to the users of the system, compared with the current situation).

The Proposed solutions step includes sub steps such as: Purpose (Roles of the system);

Proposed organisation (description of the proposed organisation structure with its main operational nodes such as ROCs, NOC, their relations and responsibilities);

Proposed system (description of the system and subsystems types, such as different types of sensors and VTMIS, and functionalities;

Locations (of subsystems and operations centers; this part includes results of the study of coverage by sensors);

Subsystem configuration types (exact subsystem configuration);

Subsystem type allocations (allocation of the subsystems, sensors namely, to selected Locations);

Operational Node connectivity (identification of the relations and information flows between the Operational Nodes);

Project Phases (description of the proposed phasing of introduction of the new system).

The Operating concept step includes sub steps such as:

Operations of the system (overview of the main operations which are foreseen to be performed by the organisation using the system);

Organisation and task analysis: Organisation analysis (for each region in the area to be covered by the system, Operational Nodes, external agencies and organisations and assets involved in the performance of each Mission are identified); Operational Tasks (description of the different work phases and process steps in performing a mission); Task to Node allocations (Tasks that are to be performed for achieving a mission are allocated to the identified Operational Nodes and the identified work phases); Operators Roles (identification of the different types of operators in the new organisation); Task to Role allocations (allocation of the identified Operational Tasks to the Operators Roles);

Operating Modes: Modes description (identification of the different modes of operation in which the organisation will be using the system; this definition can combine operational alert states of the organisation with states of the system; Manning concept (description of the manning configurations needed in the different identified modes of operation);

Expected issues and back up plans (description of the manning configurations needed in more extraordinary situations, for example one Operational Node replacing an other Operational Node which became unavailable).

The Proposed support environment step includes sub steps such as:

Logistics (high level overview of the logistics support environment);

Training and on-going support (high level overview of the training and on-going support concepts)

The Operational scenarios step consists mainly in describing a number of operation scenarios illustrating the role of the organisation and the proposed system in performing the identified missions.

This embodiment of the method of the invention described above integrates in the specification phase the organisational and technical needs of the users. Doing so will enable the designer of the system to make sure sensors, intelligence sources, decision support tools, worksets, Operational Nodes and staffing are planned in a manner which corresponds to the intended mission coverage. More specifically, the combined modelling of the operations of the system with integration in a single HCI of information from sensors, intelligence and decision support tools, using a definite group of technologies, will allow the users to understand what will be the level of confidence they can reach from automatic data processing in comparison to manual data interpretation. They will then be able to define Operating Modes and corresponding staffing requirements with an unusual level of confidence, when compared with methods and systems of the prior art. Staffing requirements for the Operational Nodes and the subsystems in each Operating Mode will be determined from the outputs of the Organisation and task analysis sub step such as Tasks to Nodes and Tasks to Roles allocations matrices. These will be the base for budgeting the human resources necessary to staff the Operational Nodes and the sub systems when combined with definitions of the time necessary to perform each Task and of the working environment constraints (e.g., working hours, vacation allocations, etc.).

In an embodiment of the invention, specific steps are performed to define the HCI of the system. The invention as a whole is unique in the sense that it focuses on the operational aspects of the system instead of the hardware and software architecture like methods of the prior art. The HCI part of the specification process is illustrated on FIG. 11. It starts from the outputs of the Project Statement step of the embodiment of the method according to the invention described hereabove. The method uses Unified Modelling Language (UML) diagrams well known by the man skilled in the art of software design. The method fits into a flexible user interface definition concept. The resulting model represents a generic system with all available subsystems and functions. Of course, for a specific system to be delivered to a definite set of users, some of the available subsystems and functions can be left out when not applicable to the users' requirements or configuration without being removed from the model. The model includes a generic part and programme specific parts which represent the specific system configuration. The programme specific part can be restructured at each level: screens, windows, sub-windows, window contents, tabbed panes. The versatile structure of the method and the tool to support it bring a lot of efficiency to the HCI design process in this embodiment of the invention. The HCI design process in this embodiment of the invention includes four steps.

The first step is Business Analysis which includes the following sub steps:

Making Business Use Case (BUCs) Diagrams: BUCs at the highest level are derived from the Missions, Goals, Tasks of the users' organisation; the Business Actors are the entities that want to achieve the BUC, contribute to achieve the BUC or are influenced by the BUC; the diagrams can be decomposed into lower level BUC diagrams down to a level that allows the BUCs to be described by a Business Activity Diagram;

Drawing Business Activity Diagrams: such diagrams show the main flow of activities that are performed by the organisation to achieve each BUC;

Developing a Role Map: such map shows all the workers in the organisation (Roles) who contribute to the BUCs; the Role Map shows the worker types and their organisation structure;

Drawing Swimlane Diagrams for each of the BUCs: a Swimlane Diagram shows a number of columns (swimlanes), each representing one of the actors or workers who are involved in the BUC; the activities identified for the BUC are allocated to these swimlanes based on the chronological flow in the Activity Diagrams; the Swimlane Diagrams can also show Entities (e.g. information or goods) being produced, consumed or exchanged between swimlanes; if many entities are identified which are related to each other, an Entity map may be produced to show these relationships.

The second step is Task Analysis which includes the following sub steps:

Creating a Task Case (also called System Use Case) for each of the Business Activities that is to be supported by the System. The BUC swimlane diagrams show which workers in the organisation perform these Business Activities. At System Use Case (SUC) level, for each worker a Role is identified. For each Role a SUC diagram is made, showing all the SUCs performed by that Role. If there are many SUCs, they can be split up in several diagrams, e.g., based on their operational coherence (see also next step);

Assembling Task Case Maps: these maps are structured based on related tasks; they show relations between tasks and hierarchy of tasks; at this step, a check is run to verify that there is no missing task; tasks resulting from the technical aspects of the system, like setting parameters or running a test may be included;

Producing a Logical Interaction Diagram for each of the Task Cases: these are swimlane diagrams with only two lanes, one for the system and one for a user, which show the interaction between user and system.

The third step is Interaction Design which includes the following sub steps:

Defining Interaction Contexts, ie groups of interactions that the system has to perform to provide to a user the information and functionality that have been specified;

Producing Content Maps which represent conceptual screen layouts where screen space is allocated to Interaction Contexts, thus showing where information and functions will be available on the user's screen(s);

Producing Navigation Maps showing how the user can navigate between groups of functions and information within a single Interaction Context;

Modelling the information to the user in Boundary Class Diagrams; each boundary class contains the specification of the format and value ranges of each information item;

Developing the Physical Interaction Design; the design can be made using a GUI builder, producing a high fidelity prototype of the HCI;

Producing Logical Interaction Diagrams which present the detailed specification of the Physical Interaction in the form of a documentation of the activities; these diagrams may be supplemented by State Diagrams that show when specific actions are enabled or disabled, when information is displayed, etc.

The fourth step is User Validation or Usability Testing. It involves real end-users in validating the HCI solutions. Scenarios are specified and users are allocated tasks to perform using a working prototype of the system. Events can be initiated from simulation processes and the user's performance is monitored and recorded for later evaluation. Users can also be asked to fill in questionnaires after each experiment. Results of these usability tests flow back in the process where appropriate in order to enhance the system HCI solutions. Usability Testing is not the first point in the process where end-users can be involved. Basically, at each stage verification can take place with end-users. End-users and domain experts are typically needed during Business Analysis.

Feed-back during the HCI User Validation step may be looped back to the Business Analysis process and modify the CONOPS without too much redesign because it occurs quite early in the development process.

The process can be supported by a set of tools. For instance diagrams, maps and models can be produced with software/system engineering tools like Rose or Rational Software Developer (RSD) from Rational. This toolset also includes a tool for designing the GUI (Eclipse). Libraries of GUI components can be found off-the shelf (COTS) or developed by the system developer.

The specification presents examples of a defense system proposed for a coastal environment. It is though apparent that the invention can be applied to other environments, terrestrial or urban. The type of sensors will be different and their coverage will also be very different but the same principles and tools will apply. Moreover, the benefits of the invention will be higher since other environments will probably be more demanding in terms of intelligence fusion because the level of confidence which can be attributed to the sensors will be lower, specifically in urban or forest environments where multipath ruin the integrity of electro-magnetic sensors. Also, the specification method according to the invention is not environment specific. Accordingly, there is no domain limitation in the claimed invention.

The invention claimed is:

1. A safety and security system for a definite area comprising:

a plurality of sensors each configured to capture a first set of data comprising instant-track data on a first set of objects located in said definite area or in the vicinity thereof, said first set of instant-track data comprising at least real-time position and speed data from at least one sensor on at least one of the objects of said first set of objects;

a plurality of information sources each configured to capture a second set of data comprising non instant-track data on a second set of objects, said second set of non instant-track data comprising at least information related to identification, position or behavior history of at least one of the objects of said second set of objects;

a processor configured to perform a first process to correlate members of the first set of objects with members of the second set of objects to produce correlated members, and the processor further configured to perform a second process to compute threat levels of the members of the first set of objects from said first and second sets of data assigned to said correlated members, the threat levels indicating the levels of a risk of a possible future incident on the definite area posed by the members of the first set of objects;

a memory containing a database in communication with the processor, the processor further configured to manage the instant-track data and the non-instant-track data; and a network in communication with the processor, the network adapted to selectively distribute the instant-track data and the non-instant-track data to users of the system.

2. The system according to claim 1 wherein said processor is configured to compute threat levels based on a result of a third process performed by the processor, the third process adapted to detect and to handle anomalies in the behavior of said correlated members.

3. The system according to claim 2 wherein said processor in performing the third process is configured to:

detect an anomaly using as an input at least one indicator from at least one agent and at least one mapping matrix and produces as output at least one information selected from a group consisting of anomalies report, specific alert, operators advice and general alert.

4. The system according to claim 3 wherein said anomaly detection sub-process uses a reasoning engine.

5. The system according to claim 2 wherein said processor in performing the third process is configured to perform a risk analysis sub-process which receives a surveillance picture and produces an action list.

6. The system according to claim 1 wherein the second set of data comprises information received from transponders on-board at least a portion of the members of the first set of objects and wherein the threat levels of said members are computed at least partly from a value of a variable defining consistency of the information received from the transponders with other items of the first and second sets of data for said members.

7. The system according to claim 1 wherein the second set of data comprises a definition of specific zones within the definite area which are used to compute the threat levels of targets entering said zones.

8. The system according to claim 1 wherein the second set of data comprises expected kinematics patterns for classes of objects and wherein the threat levels of members of the first set of objects which belong to said classes are computed at least partly from a value of at least one variable defining a deviation from said kinematics.

9. The system according to claim 1 wherein the second set of data comprises history footprints of tracks of classes of objects and wherein the threat levels of members of the first set of objects which belong to said classes are computed at least partly from a value of at least one variable defining a deviation from said history footprints of tracks.

10. The system according to claim 1 wherein the second set of data comprises a definition of specific zones within the definite area which are taken into account to compute the threat levels of targets coming out from said specific zones.

11. The system according to claim 1 wherein the second set of data comprises route plans for at least a portion of the members of the first set of objects and wherein the threat levels of said members are computed at least partly from a value of at least one variable indicating consistency of the information received from the sensors with the route plans.

12. The system according to claim 1 wherein the second set of data comprises trade patterns for classes of objects and wherein the threat levels of members of the first set of objects which belong to said classes are computed at least partly from a value of at least one variable indicating a deviation from said trade patterns.

13. The system according to claim 1 wherein the second set of data comprises classes of patterns of tracks representative of classes of events tagged with a level of threat and wherein the threat levels of members of the first set of objects which follow tracks belonging to said classes of patterns are computed at least partly from a value of the level of threat assigned to the matching class of events.

14. The system according to claim 1 wherein the second set of data comprises classes of incidents in tracks representative of classes of events tagged with a level of threat and wherein the threat levels of members of the first set of objects which follow tracks belonging to said classes of incidents are computed at least partly from a value of the level of threat assigned to the matching class of events.

15. The system according to claim 1 wherein the second set of data comprises classes of standard tracks representative of classes of objects and wherein the threat level of members of the first set of objects which belong to a definite class and deviate from the standard track attributed to the object class will be computed at least partly from said deviation.

16. The system according to claim 1 wherein the second set of data comprises information extracted from intelligence reports and wherein correlation of members of the first set of objects to members of the second set of objects is based on a combination of user-defined alert parameters.

17. The system according to claim 1 wherein the information extracted from the first and second sets of data has distribution attributes based at least in part on interest zoning parameters and on information attributes.

18. The system according to claim 1 wherein computer composed area operational pictures are displayed to sets of operators.

19. The system according to claim 18 wherein the computer composed area operational pictures are selected and grouped in worksets determined at least partly as a function of roles defined for said set of operators, each role having configurable attributed tasks to accomplish configurable attributed missions.

20. The system according to claim 19 wherein the worksets are fit to be arranged at least partly as a function of a workflow among operators.

21. The system according to claim 19 wherein the worksets are fit to be made dependent upon a set of alert-state-dependent operation modes which impact the list and workload of tasks for at least one role.

22. The system according to claim 18 wherein the computer composed area operational pictures to be displayed are composed at least partly as a function of a user defined minimum threat level to be addressed and of available computer and display capabilities.

* * * * *